US006199286B1

(12) United States Patent
Reed, Jr. et al.

(10) Patent No.: US 6,199,286 B1
(45) Date of Patent: Mar. 13, 2001

(54) WEAPONRY SIGHT DEVICE

(76) Inventors: Robert L. Reed, Jr., 623 E. Main St., Greenwood, IN (US) 46143; Edwin D. Reed, 4366 E. 575 North, Whiteland, IN (US) 46181

( * ) Notice: Subject to any disclaimer, the term of this patent is extended or adjusted under 35 U.S.C. 154(b) by 0 days.

(21) Appl. No.: 09/119,186

(22) Filed: Jul. 20, 1998

Related U.S. Application Data

(63) Continuation-in-part of application No. 08/660,167, filed on Jun. 3, 1996, now Pat. No. 5,782,002.

(51) Int. Cl.[7] ..... F41G 1/467
(52) U.S. Cl. ..... 33/265; 33/241; 124/87
(58) Field of Search ..... 33/265, 241, 253, 33/259, 260, 283, DIG. 21; 124/87

(56) References Cited

U.S. PATENT DOCUMENTS 4,120,096 * 10/1978 Keller ..... 33/265
4,325,190 * 4/1982 Duerst ..... 33/265
4,616,422 * 10/1986 Gaddy ..... 33/265
4,660,289 * 4/1987 Wilhide ..... 33/265
4,894,921 * 1/1990 Barlow ..... 33/265
4,928,394 * 5/1990 Sherman ..... 33/265
5,092,308 * 3/1992 Sheffield ..... 124/87
5,419,050 * 5/1995 Moore ..... 33/265
5,495,675 * 3/1996 Huang ..... 33/265
5,782,002 * 7/1998 Reed ..... 33/265

* cited by examiner

*Primary Examiner*—Christopher W. Fulton
(74) *Attorney, Agent, or Firm*—Robert A. Spray, Patent Attorney; George Kap

(57) ABSTRACT

Apparatus for the laser guidance of the aiming function used by the shooter, and fiber optics to increase the usability of the weapon. One type of adjustment is provided by a vertically movable and vertically adjustable cam member; and a second adjustment is provided through arm linkage which adjusts a rotatable laser holding member. Futher features are the provision of a novel adjustable base means to adjust the laser for horizontal (windage) adjustment and also provided a standard of testing feature for testing vertical alignment. Fiber optics gives the shooter the means by which he is able to aim and shoot at farther targets in comparison to the lasers' limits of rangeability; and this fiber optic feature supplements the laser feature of the sight device, and the sight provides a novel sight pin feature. An adjustable lens device provides that the laser beam can be adjustably expanded rather than constricted.

45 Claims, 13 Drawing Sheets

WEAPONRY SIGHT DEVICE

I. CROSS-REFERENCE TO THE RELATED APPLICATION

This is a Continuation-In-Part of U.S. patent application, Ser. No. 08,660,167, entitled "LASER GUIDANCE MEANS" filed Jun. 3, 1996 by one of the present Inventors, Edwin D. Reed, now U.S. Pat. No. 5,782,002 issued Jul. 21, 1998.

II. FIELD AND BACKGROUND OF THE INVENTION

The present invention relates to equipment for use in the activity of shooting projectiles by a firearm or a bow, more particularly to an apparatus for the laser guidance of the aiming function used by the shooter, and fiber optics to increase the usability of the weapon in bright light conditions regardless of normal fiber optics ability to be seen in low light conditions.

(Although this sighting device seems most particularly useful to a shooter at elevated heights, its concepts also provide advantages when shooting at ground elevations.)

III. BASIC PRINCIPLES AND SHORT SUMMARY

A basic principle utilized by the present invention is that gravity consistently gives a downward "drop effect" to projectiles, during the entire distance which projectiles traverse the ground; whereas a laser beam is unaffected by gravity.

Thus, the lowering of the laser with respect to the shooting apparatus causes the sighting dot to be lowered, which in turn causes the hunter to have to raise the angle of his shooting apparatus in order to bring the sighting dot back to the desired elevation at the target distance, which elevation-change causes a raising of the projectile's flight-trajectory. Such type of adjustment is provided by a vertically movable and vertically adjustable cam member.

A second adjustment provided through arm linkage adjusts a rotatable laser holding memeber, in an assembly which is novel in certain respects over the prior Reed patent.

That is, a pendulum-weighted body of the cam assembly causes the cam to remain in the same orientation with respect to the earth even though the shooting apparatus inclination is changed; and this also provides a coordination between the inclination of the shooting device with respect to the earth and the inclination of the laser unit.

Two types of laser related adjustments are provided, one being manual and the other being automatic.

A further novel feature embodied in the laser basis is the provision of a novel adjustable base means to adjust the laser for horizontal arc (windage) adjustment of a shooter's projectile, two adjusting stations being provided giving maximum precision adjustment by convenient manual means and to test or check this precision adjustment. A first frame openability feature provides a vertical alignment test to assure vertical alignment of the laser sight device and a projectile or a projectile tube.

A second advantageous feature of this sight system is the concept of the use of fiber optics to give the shooter the means by which he is able to aim and shoot at farther targets in comparison to the lasers' limits of rangeability; and thus this fiber optic feature is greatly desirable to supplement the laser feature of the sight device.

This fiber optic sight feature also provides a novel means for the shooter to adjust the fiber optic components to provide a range finding capability with the use of a novel sight pin feature.

A further novel concept is the provision of the combination of the laser having an adjustable lens device by which the laser beam can be adjustably expanded rather than constricted, this being a novel combination not provided by any prior art laser guidance systems.

These and other features are detailed herein, novel as contributing their own novel features and as co-operating components of the combinations achieved.

IV. PRIOR ART CAPABILITY AND MOTIVATIONS, AS HELPING TO SHOW PATENTABILITY HERE

In hindsight consideration of the present invention to determine its inventive and novel nature, it is not only conceded but emphasized that the prior art had details usable in this invention, but only if the prior art had had the guidance of the present concepts of the present invention, details of both capability and motivation.

That is, it is emphasized that the prior art had or knew several particulars which individually and accumulatively show the non-obviousness of this combination invention. E.g., a. The prior art has long had shooting devices of various types;

b. Laser details and the advantages of lasers as sight-assisting features are well known in the weaponry art;

c. Lasers, as fascinating articles of technology, have been known and used for many years, and have established themselves as greatly and confidently useful, and adaptable to various mechanisms in several arts;

d. Fiber optics, of various forms, have been used and incorporated into many types of apparatus for many years, and for several years have been used specifically as a guidance alignment in various weaponry;

e. Both lasers and fiber optics have been known and used worldwide, several years, but to the Inventors' knowledge have never been used in combination with each other and particularly not to create the novel combination of the present invention;

f. The prior art has had the knowledge of the typical desire of assisting the aiming for utmost precision in hitting a target accurately;

g. The prior art knew the action of target animals in moving between locations in a considerable span of distance;

h. The prior art has been aware of the problems inherent as to differences in shooting length, nature of different shooting device features in consideration of size, shape, weight "pulling strength" and force;

i. The prior art of the industry has surely supposed or known that many customers have been and surely would be quite willing to purchase improved and more accurate and consistent shooting apparatus, providing not only an easy and convenient aiming apparatus, but one which attains high precision at various distances and elevations;

j. The industry and users have surely known that even novices would hope and expect to soon attain the skill of expert marksmen, and be willing to pay for this hopeful achievement;

k. The relative ease of tooling and manufacturing of components of this shooting apparatus have surely given manufacturers ample incentive to have made modifications for commercial competitiveness in a competitive industry if obvious;

l. The prior art has always had sufficient skill to make many types of shooting aids, movable-parts products and various articles having a variety of parts, more than ample skill to have achieved the present invention, but only if the concepts and their combinations had been conceived;

m. Substantially all of the operational characteristics and advantages of details of the present invention, when considered separately from one another and when considered separately from the present invention's details and technical accomplishment of the details, are within the skill of persons of various arts, but only when considered away from the integrated and novel combination of concepts which by their cooperative combination achieves this advantageous invention;

n. The details of the present invention, when considered solely from the standpoint of construction, are relatively simple, and the matter of simplicity of construction has long been recognized as indicative of inventive creativity; and o. Similarly, and a long-recognized indication of inventiveness of a novel combination, is the realistic principle that a person of ordinary skill in the art, as illustrated with respect to the claimed combination as differing in the stated respects from the prior art both as to construction and concept, is that the person of ordinary skill in the art is presumed to be one who thinks along the line of conventional wisdom in the art and is not one who undertakes to innovate.

Accordingly, although the prior art has had capability and motivation, amply sufficient to presumably give incentive to the development of a weapon accessory according to the present invention, the fact remains that the present invention awaited the creativity and inventive discovery of the present Inventors. In spite of ample motivation and capability shown by the illustrations herein, the prior art did not suggest this invention.

V. SUMMARY OF THE PRIOR ART'S LACK OF SUGGESTIONS OF THE CONCEPTS OF THE INVENTION'S COMBINATION

In spite of all such factors of the prior art, the problem here solved awaited these Inventors' present creativity. More particularly as to the novelty here of the invention as considered as a whole, the resume of the prior art uses and needs helps to show its contrast to the present concepts, and emphasizes the advantages, novelty, and the inventive significance of the present concepts as are here shown, particularly as to utility, accuracy and convenience of use as detailed herein.

Moreover, prior art articles known to these Inventors which could possibily be adapted for this duty fail to show or suggest the details of the present concepts as combinations; and a realistic consideration of the prior art's differences from the present concepts of the overall combination may more aptly be described as teaching away from the present invention's concepts, in contrast to suggesting them, even as to a hindsight attempt to perceive suggestions from backward look into the prior art, especially since the prior art has long had much motivation as to details of the present invention and to its provisions.

And the existence of such prior art knowledge and related articles embodying such various features is not only conceded, it is emphasized; for as to the novelty here of the combination and of the invention as considered as a whole, a contrast to the prior art helps also to remind both the great variety of the various prior art articles and the needed attempts of improvement, and of the advantages and the inventive significance of the present concepts.

Thus, as shown herein as a contrast to all the prior art, the inventive significance of the present concepts as combinations is emphasized and the nature of the concepts and their results can perhaps be easier understood as inventive.

Although varieties of prior art are conceded and ample motivation is shown and full capability in the prior art is conceded, no prior art shows or suggests details of the overall combinations of the present invention as is the proper and accepted way of considering the inventiveness nature of the concepts.

That is, although the prior art may show an approach to the overall invention, it is determinatively significant that none of the prior art shows the novel and advantageous concepts in combination, which provides the merits of this invention, even though certain details are shown separately from this accomplishment as a combination.

And the prior art's lack of an invention of a shooting apparatus, achieving the convenience, accuracy, simplicity of use and other advantages of the present invention, which are goals only approached by the prior art, must be recognized as showing a long-known need, now solved.

Accordingly, the various concepts and components are conceded and emphasized to have been widely known in the prior art as to various devices; nevertheless, the prior art not having had the particular combination of concepts and details as here presented and shown in novel combination different from the prior art and its suggestions, even only a fair amount of realistic humility to avoid consideration of this invention improperly by hindsight requires the concepts and achievements here to be realistically viewed as novel combinations, inventive in nature.

And especially is this a realistic consideration when viewed from the position of a person of ordinary skill in this art at the time of this invention, and without trying to reconstruct this invention from the prior art without use of hindsight toward particulars not suggested by the prior art.

VI. COMPONENTS SUMMARIZED

7A ENLARGED PORTION OF FIG. 7
13 GUIDANCE APPARATUS
14 BOW
15 RISER OF 14
16 BOW RISER WINDOW OF 14
17 HANDLE OF 14
18 MOMENTARY SWITCH
19 SIGHT BRACKET BASE HOLES OF 82 AND 14
20 CONTAINMENT FRAMING HOUSING OR BOX OF 13
20A BOTTOM WALL OF 20
22 AJUSTMENT SLOTS OF 20'S WALL 36A
24 SWITCH OF 20
25 ELECTRICAL CIRCUITRY
25A BATTERY IN 108
25B & 25C CONTACTS OF 43C AND 43D FOR 43B
26 AJUSTMENT HOLE OF 20A FOR 46

28 JAM NUT FOR LIGHT RECEIVERS 30
30 LIGHT RECEIVER OF 30A
30A LIGHT RECEIVER ASSEMBLY
31 FIBER OPTIC ADJUSTMENT TUBE OF 30A
32 JAM NUT OF 31
33 CRIMP NUT OF 31
34 DARK CLADDED SCINTILLATIVE FIBER OPTIC CABLE
35 CONTAINMENT HOUSING WINDOW FOR 66 AND ACCESS OPENING FOR ADJUSTMENT SCREW 56
35A FORWARD WALL OF 20
36 SIDE COVER PLATE OF 20
36A CONTAINMENT HOUSING WALL OF 20 WITH SLOTS 22
38 COVER PLATE SCREWS OF 36
39 CAM OF 48
39A CAM TRACK OF 39
40 MULTI-PURPOSE COMPONENT OF 20 OR MECHANISM
40A MALE THREADS OF COMPONENT 40
40B FEMALE THREADS OF 20 FOR 40
40C PISTON OF 40
40D SPRING OF 40
40E OUTWARD WALL OF 40
40F INNER WALL OF 40
41 PIN SUPPORT HOLES OF 36 & 36A OF 20
41A SUPPORT HOLE OF 50 FOR 42
42 LASER HOLDER AXLE PIN OF 42A
42A LASER HOLDER OF 68
43 L.E.D. SOCKETS OF 48 FOR 43A
43A LIGHT EMITTING DIODES/L.E.D.∓S OF 48
43B L.E.D. CIRCUITRY OF 48
43C AXLE OF 48
43D AXLE OF 48
44 CAM LUG OF 39
44A THREADED HOLE OF 44 FOR 46
45 SQUARE WALL OF 39 TO BLOCK 44 FROM TURNING
46 ADJUSTMENT SCREW TO 44A
47 SPRING OF 48
48 PENDULUM ASSEMBLY OF 20
48A TOP PORTION OF 48
48B VERTICAL CHANNELS OF 48 FOR 43B
48G LOWER PORTION OF 48
49 SPRING NEST OF 48
50 LASER HOLDER ADJUSTMENT ARM OF 68
52 FINGERS OF 50
54 90 DEGREE BENT TAB/EAR OF 50
54A ACCESS CLEARANCE HOLE OF 54 FOR 56
56 LASER HOLDER ADJUSTMENT SCREW OF 68
58 SPRING OF 68
59 HOLE OF 42A FOR 56 ACCESS
59A THREADED HOLE IN 60 IN 63 OF 42A
59G LASER RECEIVER HOLE OF 42A OF 68
60 ADJUSTER SHAFT/PIN OF 42A OF 68
62 LOCK NUT OF 56 OF 68
63 HORIZONTAL HOLE OF 42A FOR 60
64 LASER DIODE OF 68
66 LASER BEAM OF 64
68 LASER HOLDER ASSEMBLY OF 20
70 SEALED LIGHT CHAMBER OF 20
72 LIGHT SOURCE OF 70
74 UNCLAD PORTION OF 34 IN 70
76 FIBROUS CLADDING OF 34
78 SIGHT PIN OF 80
80 LIGHT OUTPUT ASSEMBLIES
82 SIGHT BRACKET OF 13 (mounting means)
84 2 VERTICAL AJUSTMENTS SLOTS FOR 80 OF 82
86 INNER-LIGHT OUTPUT AJUSTMENT TUBE OF 80 FOR 78 AND 34
88 LIGHT TRANSFER AJUSTMENT CHAMBER OF 86
90 LIGHT OUTPUT AJUSTABLE TUBE HOLDER OF 86
92 JAM NUT OF 90
93 FIBER LOCK WASHER OF 80
94 JAM NUT OF 86
96 CRIMP NUT OF 86 ON FLEXIBLE FIBER OPTIC END
100 CRIMP NUT ON SIGHT PIN END OF 86
102 METAL CLADDING OF 78
104 INTERIM PORTION OF 78
106 ADJUSTMENT BASE OF 13 FOR 20
107 2 PORTIONS OR ADJUSTMENT STATIONS OF 106
108 BATTERY COMPARTMENT OF 106
110 2 CONTROL AJUSTMENT SCREWS OF 106
112 HEAD OF 2 SCREWS 110
113 2 LARGE BORE THREADED HOLES FOR 130 OF 106
114 CLEARANCE HOLE OF 116 FOR 110
116 2 AJUSTMENT SCREW RETAINERS FOR 110 and 112
118 2 RETAINER SOCKETS FOR 116 OF 106
119 END OF SCREWS 110
120 2 LARGE CLEARANCE HOLES OF 106 FOR 110
121 SIDE FACE (LEFT) OF 106
122 2 THREADED HOLES IN 82 and 162 for 110
123 RESTING CONTACT SURFACE OF 110 ON 116
124 CONTROL KNOBS OF 110
125 SPACE BETWEEN 106 & 121
126 2 SMALL SET SCREWS OF 124
128 2 SMALL BORE THREADED HOLES OF 124
130 2 LARGE SET SCREWS OF 106
131 SPACE BETWEEN 82 & 124
140 LUG OF 20
141 FRONT OF AJUSTMENT BASE 106 & CONTAINMENT HOUSING 20 OF 13
142 PIN HOLE OF 140
144 2 PIN HOLES OF 146 OF 106
146 FRONT SLOT OF 106 FOR 140
148 AXLE SUPPORT PIN OF 142 OF 140 & 144
149 REAR OF AJUSTMENT BASE 106 AND CONTAINMENT HOUSING 20

150 REAR SLOT OF 106 FOR 152

152 LATCH OF 106

154 PIN HOLE OF 152

156 REAR PIN HOLES OF 150 OF 106

158 AXLE PIN FOR 152, 154 AND 156

160 SLOT OF 20 FOR 152

162 WEAPON FOREARM STOCK (SIGHT MOUNT HANDLE)

164 CROSS BOW SUPPORT RAIL ARROW FIRING RAMP)

166 RESTING SUPPORT OR FIRING SUPPORT LOCATION FOR ARROW (BOLT)

168 RECESSED POCKET OF 162 FOR 13

170 WEAPONS PROJECTILE TUBE

172 DUAL POWER JACK OF 20

174 2 TERMINALS of 172 of 20

176 LASER CIRCUITRY OF 20

178 ACCESS HOLES OF 22 FOR 30

180 ADJUSTABLE LASER LENS UNIT

VII. BRIEF DESCRIPTION OF THE DRAWINGS

The above description of the novel and advantageous invention is of somewhat introductory and generalized form. More particular details, concepts, and features are set forth in the following and more detailed description of illustrative embodiments, taken in conjunction with the accompanying Drawings, which are of somewhat schematic and diagrammatic nature for showing the inventive concepts; and in the Drawings:

FIG. 1 is a pictorial view of the overall assembly, as mounted on a bow, with portions of the containment housing broken away to avoid obscuring interior details, with the riser and the handle shown in chain lines, and the momentary switch shown assembled onto the handle;

FIG. 2, in the form of an exploded view, shows the containment housing with associated hardware, and the pendulum assembly and with the adjustable mounting bracket and adjustable base for the containment housing, both showing associated hardware, and laser holder components;

Figure 1:
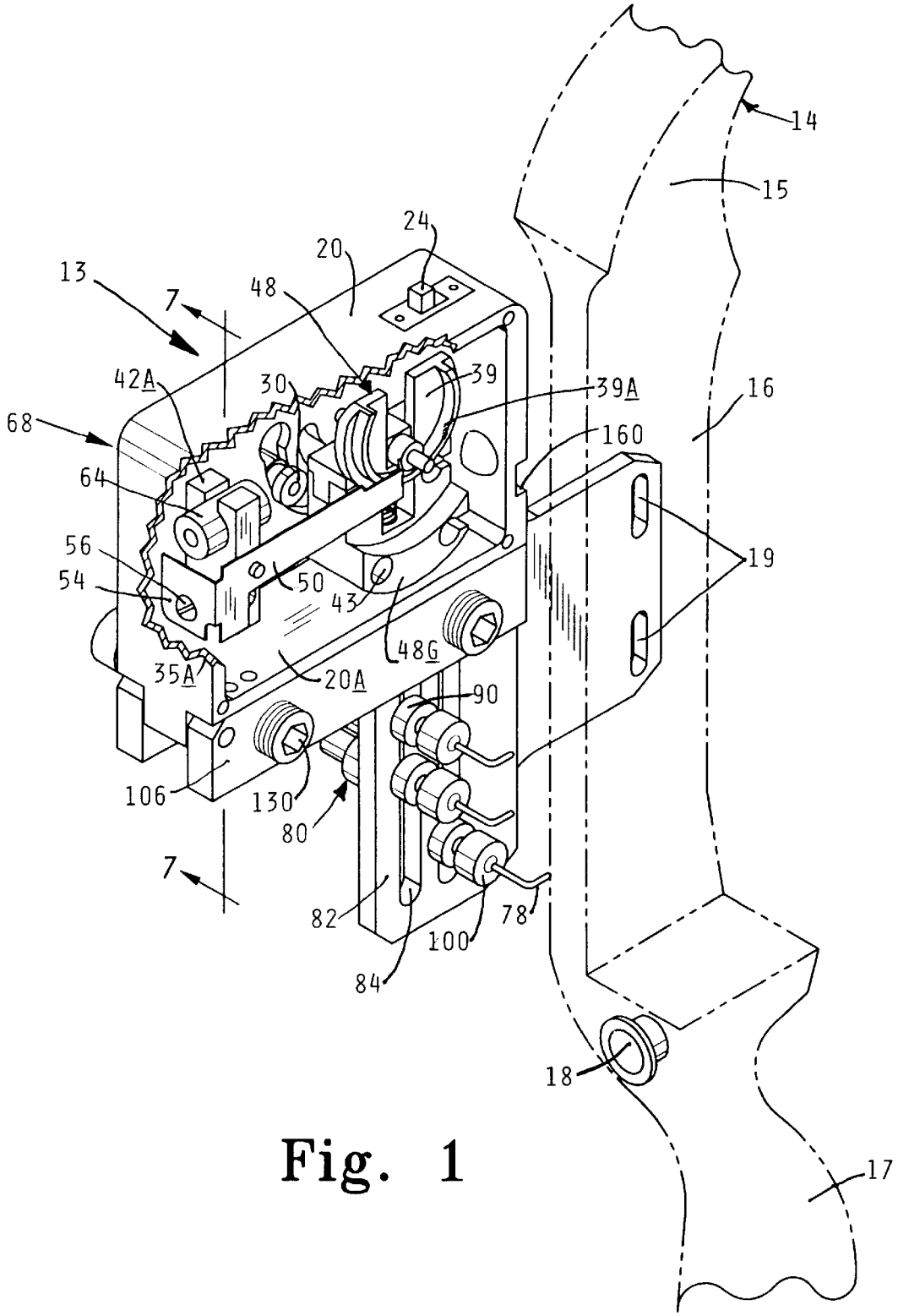
Figure 3:
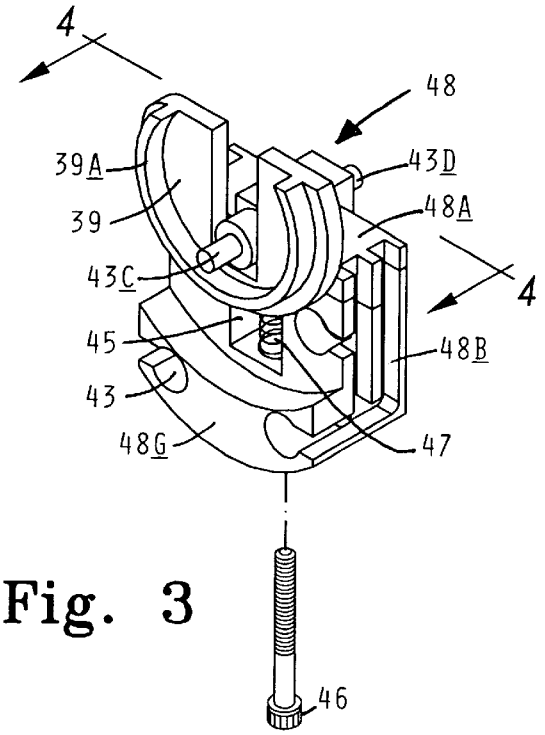
FIG. 3 is a pictorial view of the pendulum assembly, showing the cam shown in FIG. 3A and other Figures.
Figure 4:
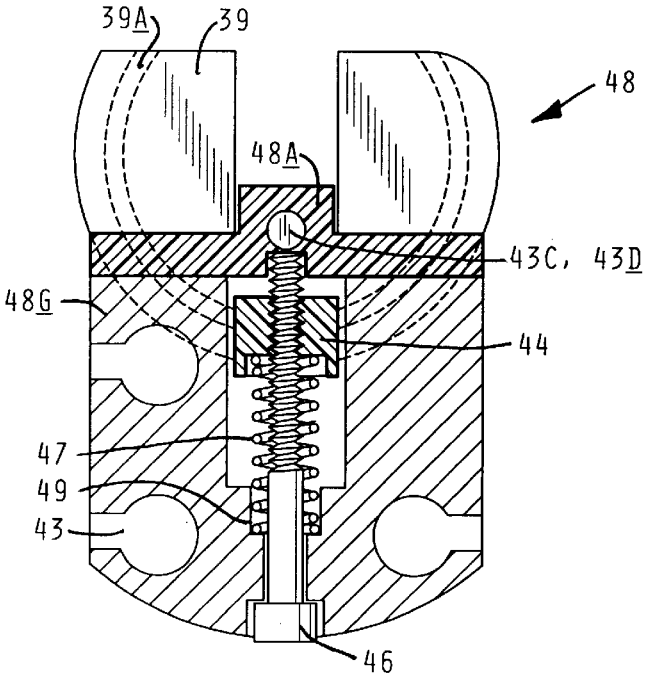
Figure 5:
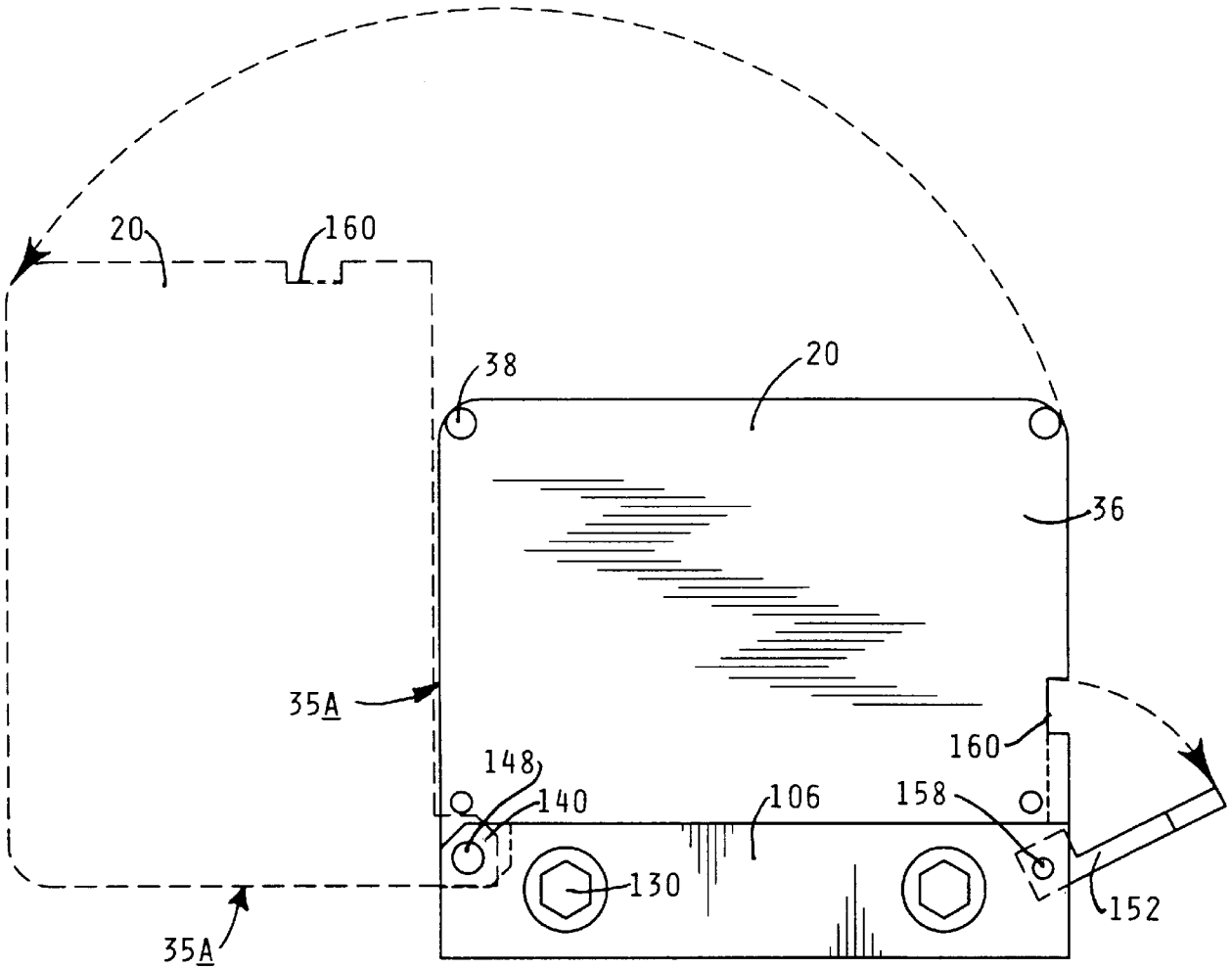
Figure 6:
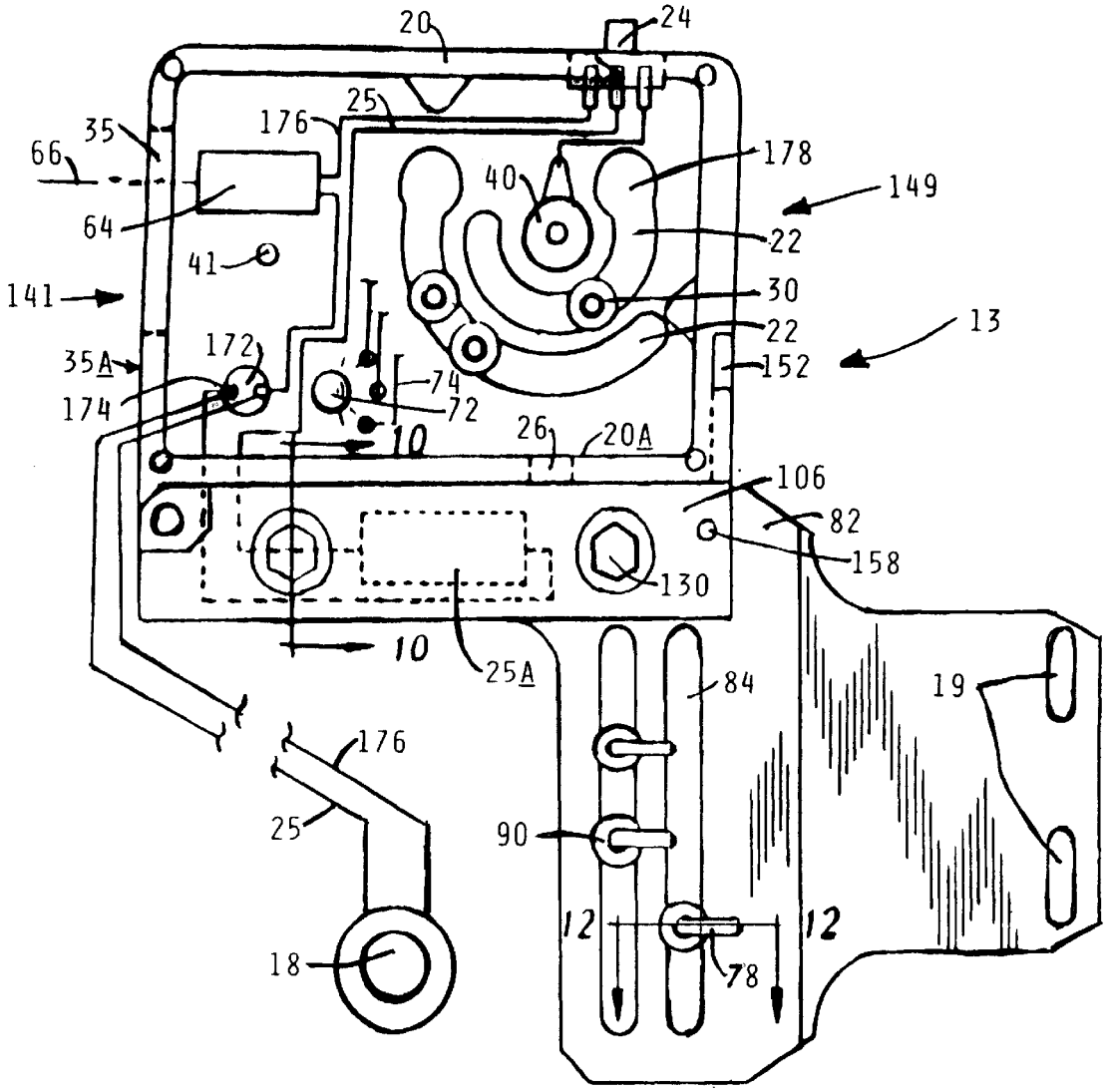
Figures 7, 7A:
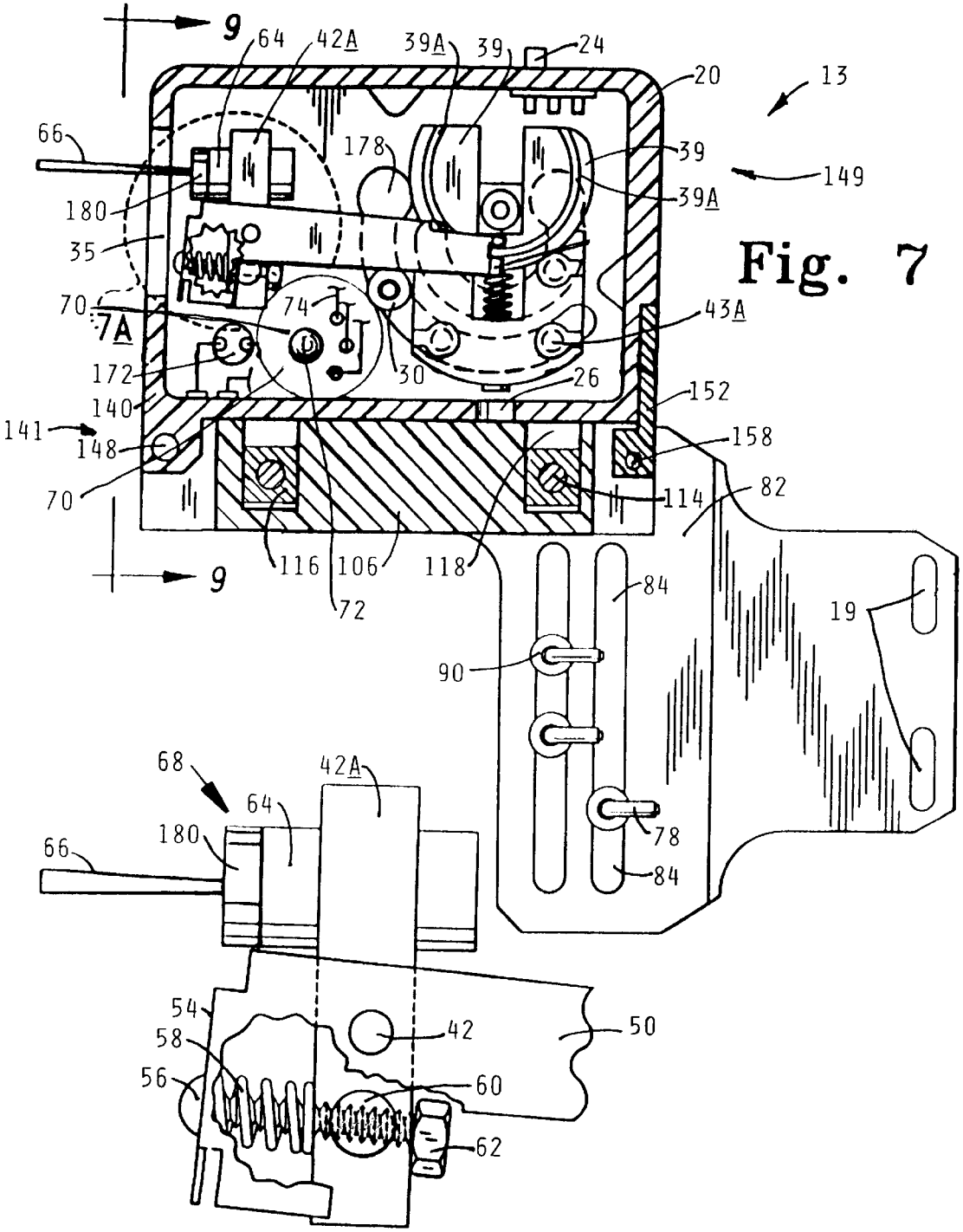
Figure 8:
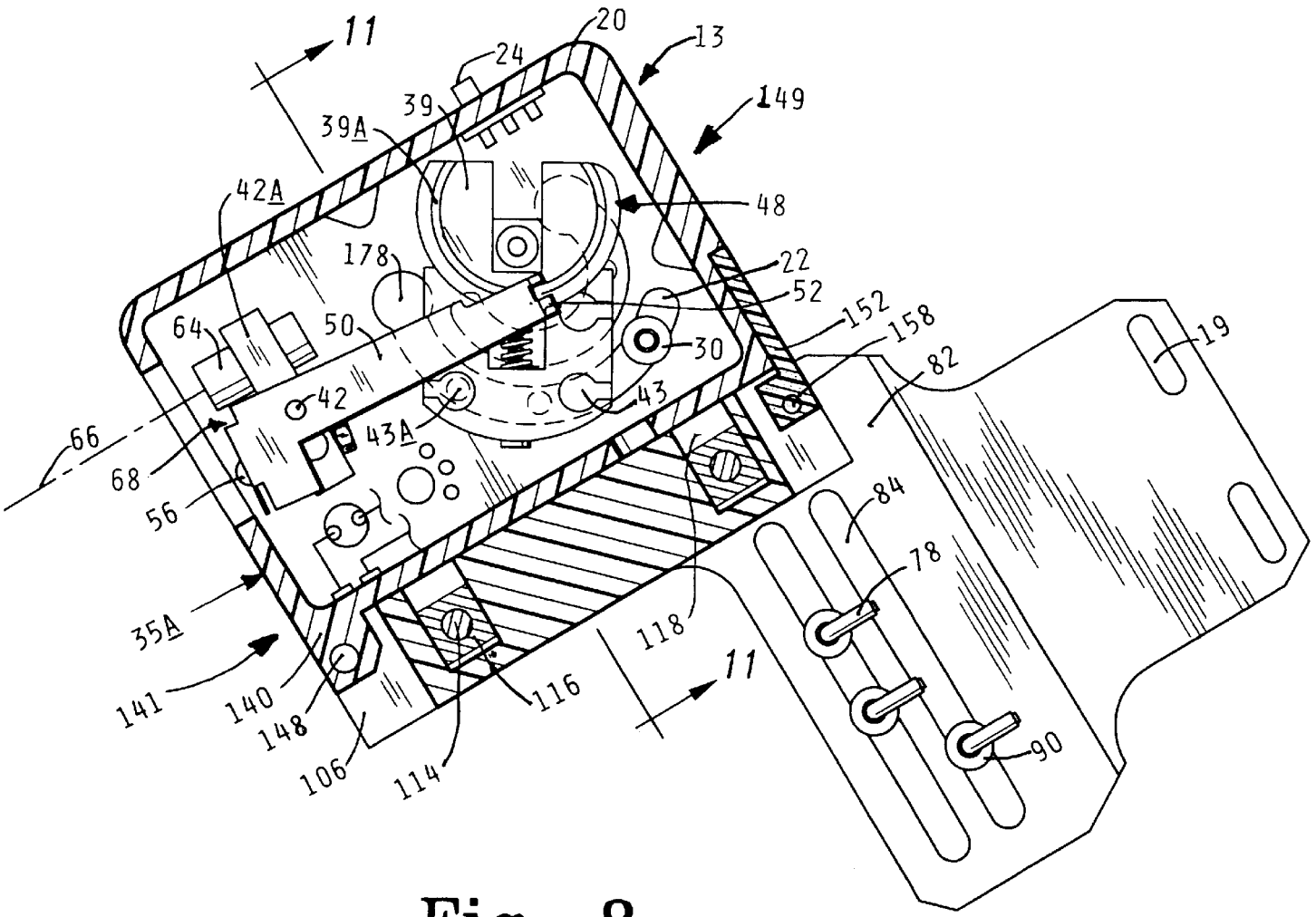
Figure 9:
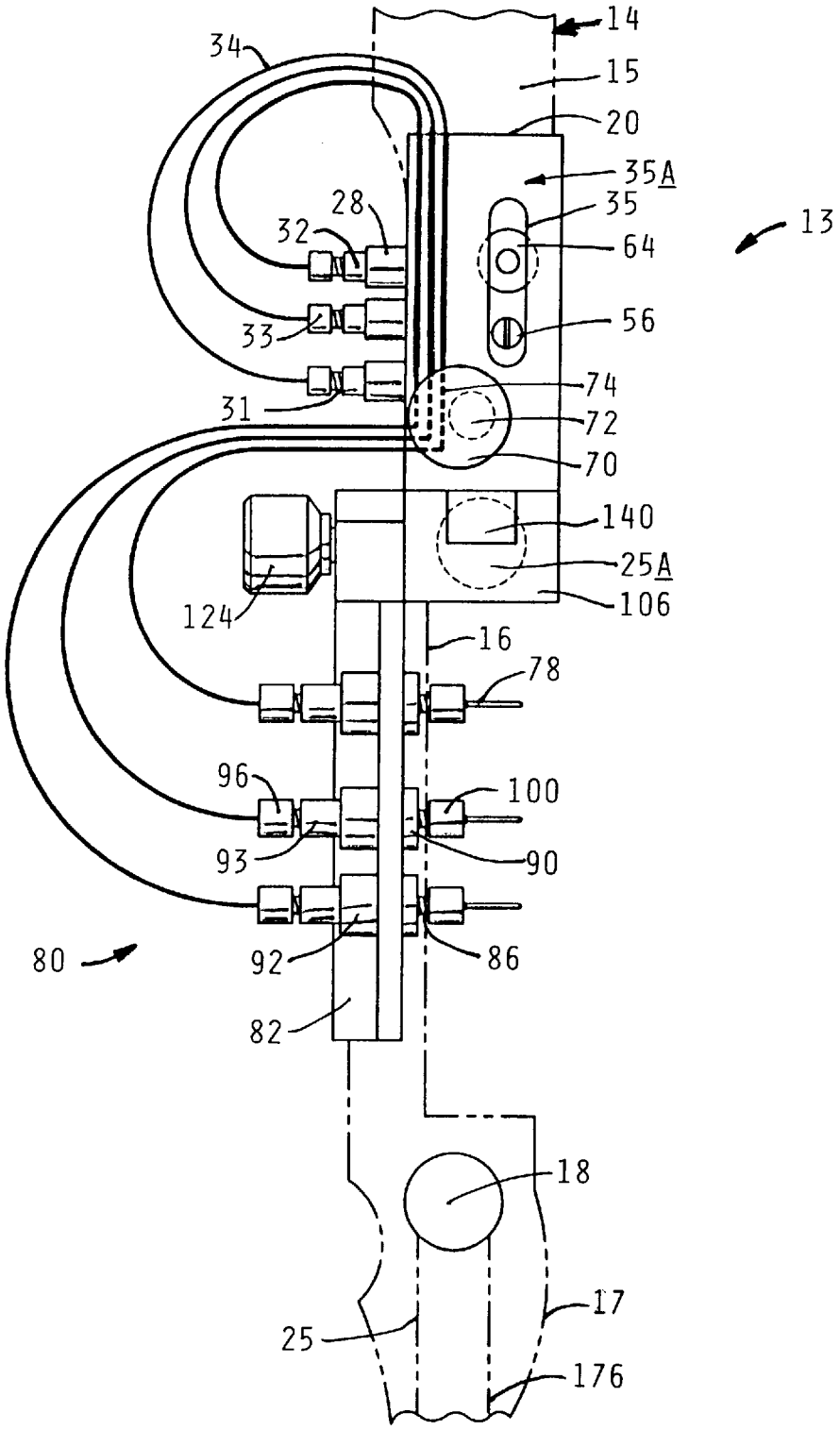
Figure 10:
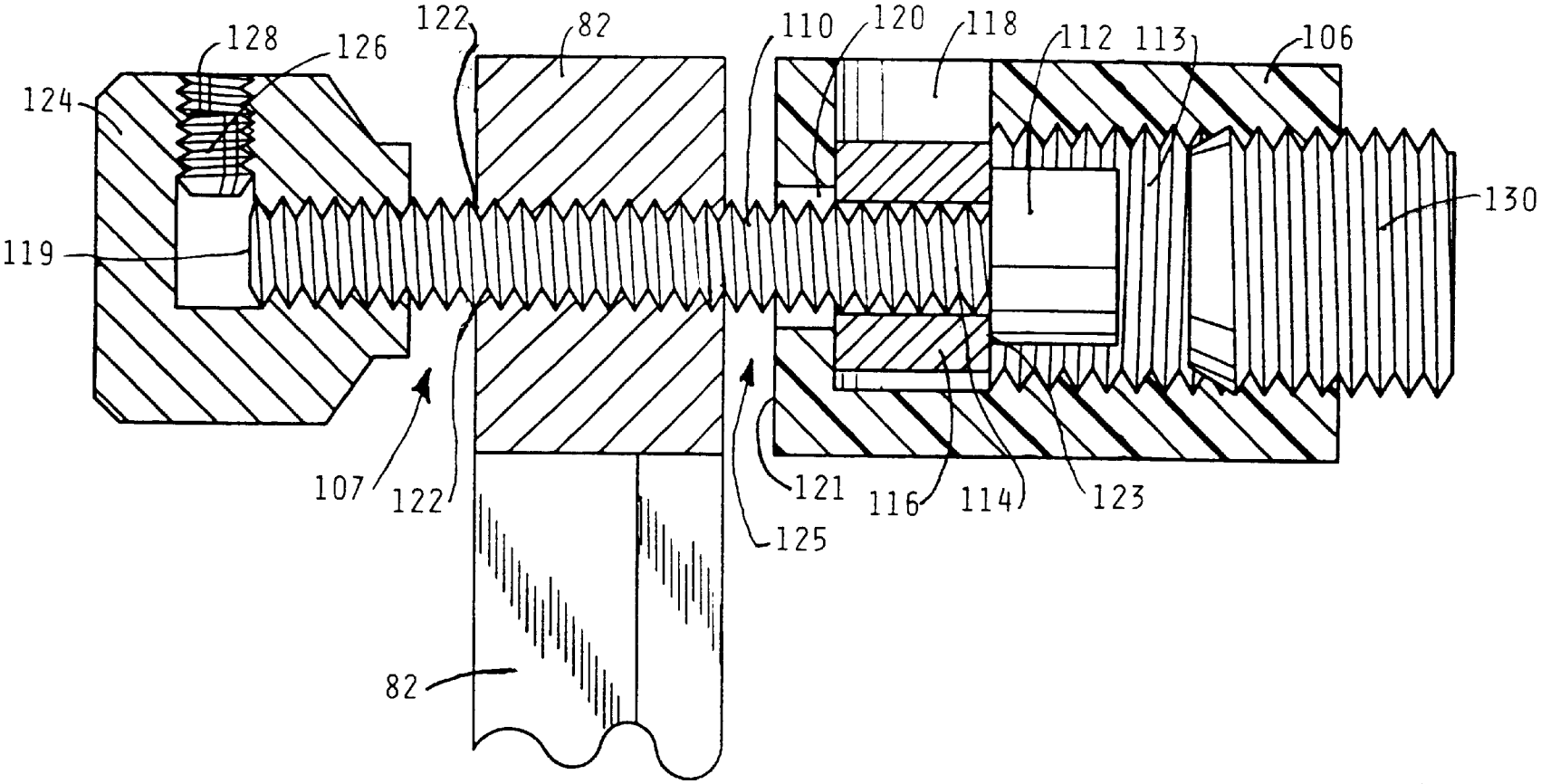
Figure 11:
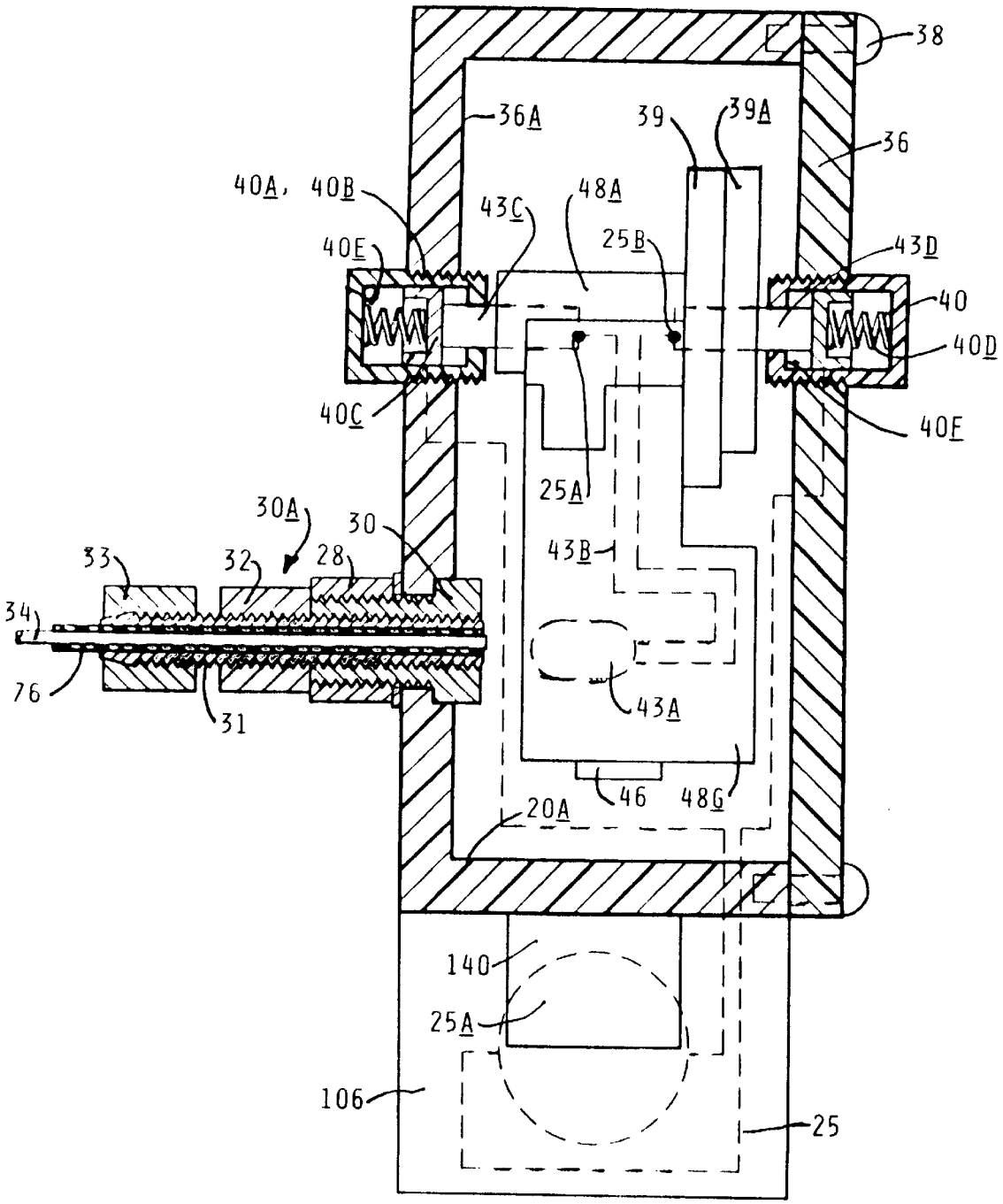
Figure 12:
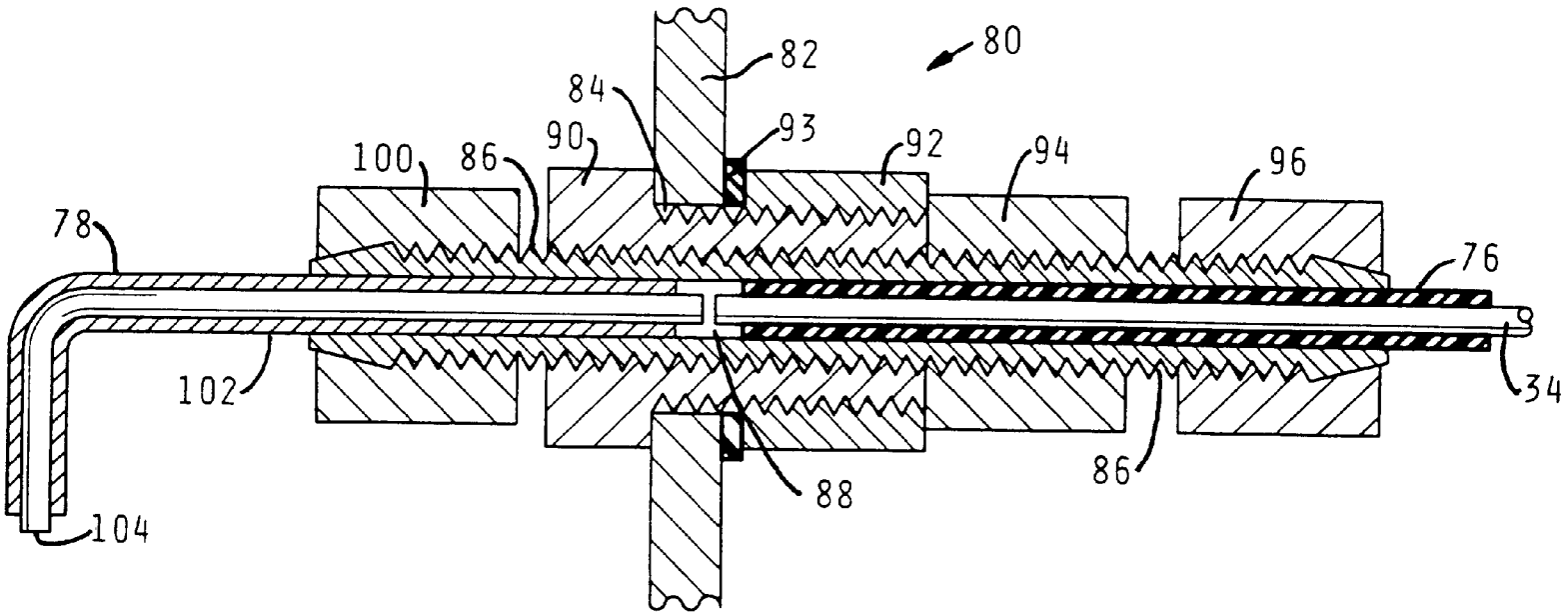
Figure 13:
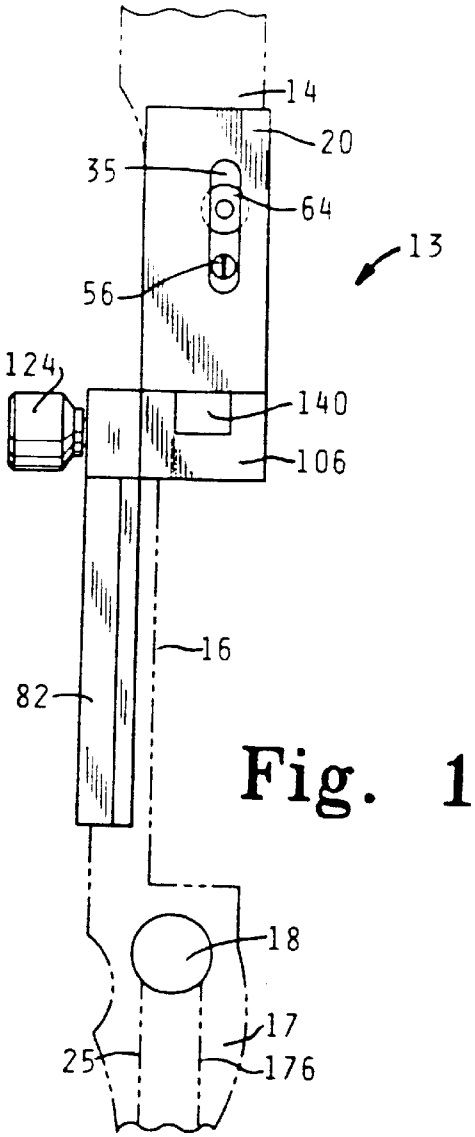
Figure 14:
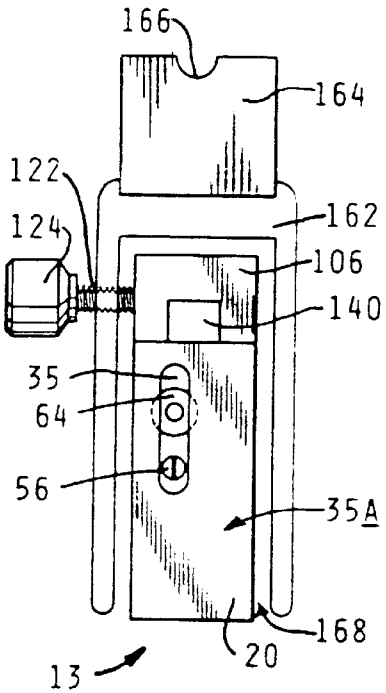
Figure 15:
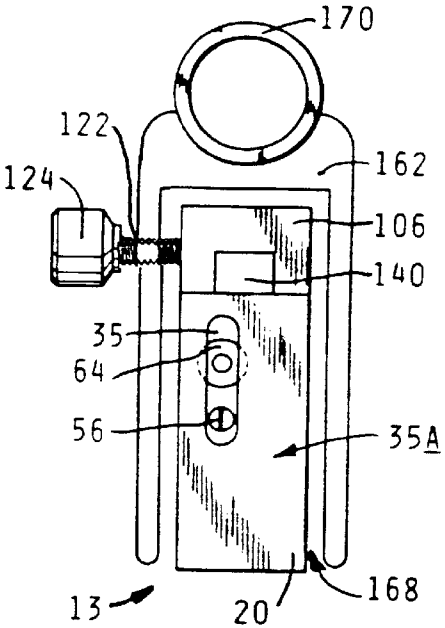

FIG. 4, in enlarged scale, is a vertical cross-sectional view, generally as shown taken by the cutting plane 4—4 of FIG. 3, the parts generally shown as in the condition of almost its maximum allowable trajectory position as to the flight path of the arrow being shot;

FIG. 5 shows an elevation view of the adjustable base and the containment box' path of movement by an arced dash line. The box and base are moved in sequence to achieve laser and projectile alignment. A latch shown is a secure closing device;

FIG. 6 is an elevation view of the containment housing with fiber optic adjustable holders and associated fiber optic and electrical circuitry with associated components, the laser, and its output beam and the battery shown in dash lines, and with the dual sight bracket which supports the containment housing base for the laser and fiber optic sights;

FIG. 7 is a vertical cross-sectional view per Section line 7—7 of FIG. 1, generally as of the components shown in FIG. 6, but showing more of the interior features of the containment housing and its operating circuits and components, showing by a dash line circle and labelled "7A" a portion of FIG. 7 which is enlarged for magnification purposes in FIG. 7A;

FIG. 7A is an enlarged magnification of the portion of FIG. 7 which is labelled in FIG. 7 with the reference indicator "7A";

FIG. 8 shows generally the parts as shown in FIG. 7, but shows relative rotation of the containment housing and weighted body (pendulum), and alignment of the LEDs in the weighted body mounted in the containment box, the device shown angularly displaced in FIG. 8 in contrast to FIG. 7 because in FIG. 8, in order to accommodate a closer target, with the laser beam as shown as having been angularly adjusted toward a downward path in contrast to a horizontal path of the laser beam in FIG. 7, or when the LED circuitry is turned on the LEDs will send a light beam from the LEDs to the fiber optics, to one of multiple sight pins that would be adjusted to a target at this angular position;

FIG. 9 in a frontal view, generally an taken by view line 9—9 of FIG. 7, indicating the circuitry of the fiber optics, the dash lines indicating the portion in which the insulation has been removed to achieve another special feature whereby all fiber optics are allowed to receive light, the chain lines showing the associated bow;

FIG. 10, in enlarged scale, is a vertical cross-sectional view of the assembly or mounting of one of the two control screws which is turned by a manual control knob, also showing the sight bracket and the base of the containment box in relation to that control screw; and FIG. 10 is a cross-Section generally as taken by cutting plane 10—10 of FIG. 6;

FIG. 11 is a transverse vertical cross-sectional view, the dash lines generally showing electrical circuitry, and showing one of the light receivers and its fiber optic holder as mounted in the containment housing, and in the upper portion of the view showing the electrically charged adjustable pivotal supports of the pendulum by the containment housing, a base portion of the cam and other components being omitted in this view;

FIG. 12, in enlarged scale, is a cross-sectional detail view generally as taken by cutting plane 12—12 of FIG. 6, showing the improved sight pin application which consists of a sight pin holder on one end and fiber optic holder combined to make one unit, which creates a light transfer chamber between fiber optics which allows the special features of being able to remove or to change a broken pin or a broken fiber optic from the assembly or change to a different color sight pin without losing target sight position, this being a feature showing as an improvement over the prior art;

FIG. 13 is a schematic Drawing of the sight mounted onto a mounting plate providing an adjustment means, and support, the mounting plate being mounted on to the bow shown in FIG. 1;

FIGS. 14 and 15 are schematic representations of the sight mounted into the forearm handle of a cross bow or weapon, and more particularly:

FIG. 14 shows the mounting of the sight into the mounting means on the underside of the cross bow frame rail; and FIG. 15 is a schematic detail view similar to FIG. 14 except showing the mounting of the sight mounted into the mounting means on the underside of a projectile chamber of a device such as a rifle, paint ball gun, dart gun, pellet gun and/or shotgun.

Figure 2:
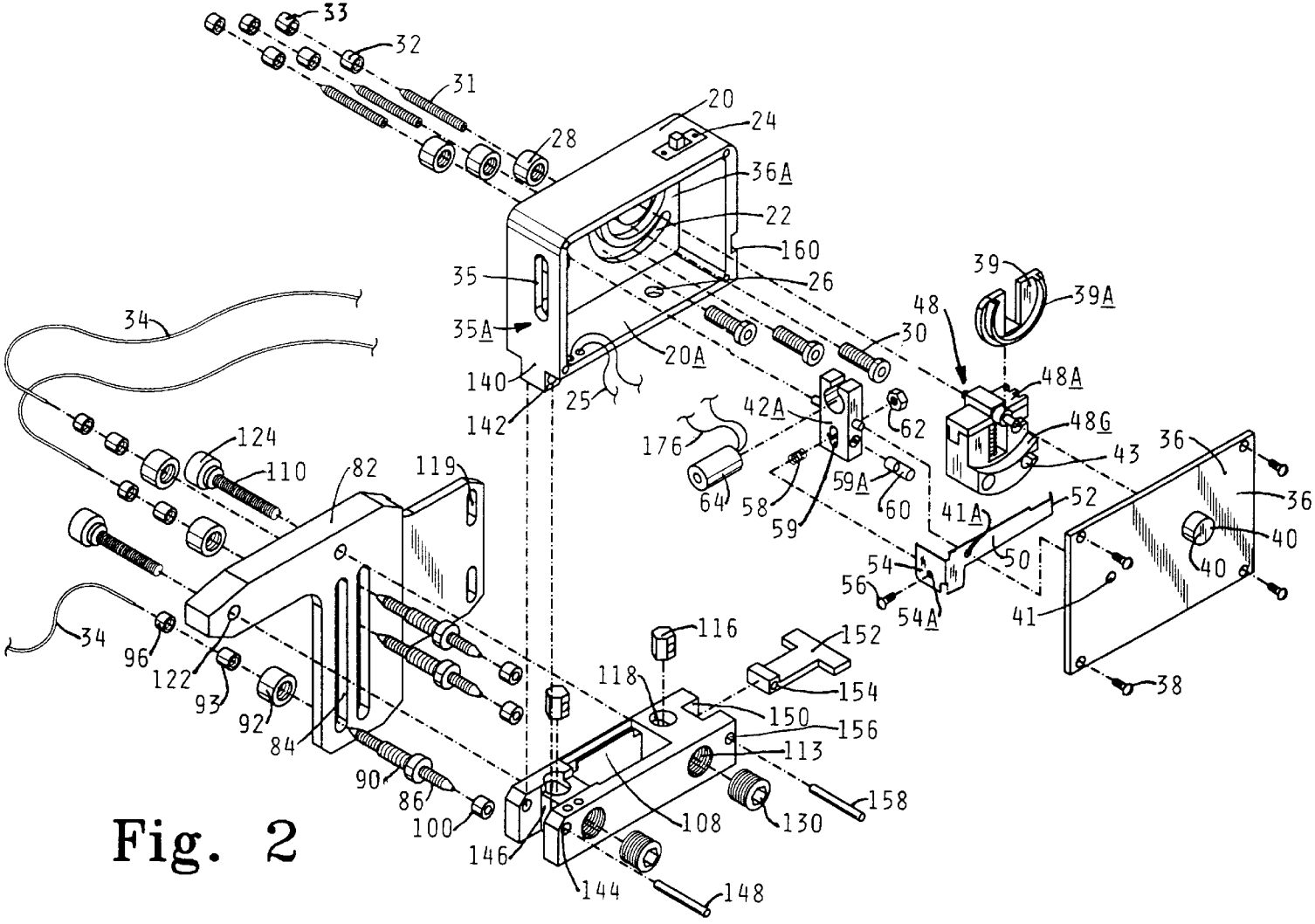
FIG. 2A is an enlarged magnification of the laser and laser holder components shown in exploded view in FIG. 2.
Figure 2A:
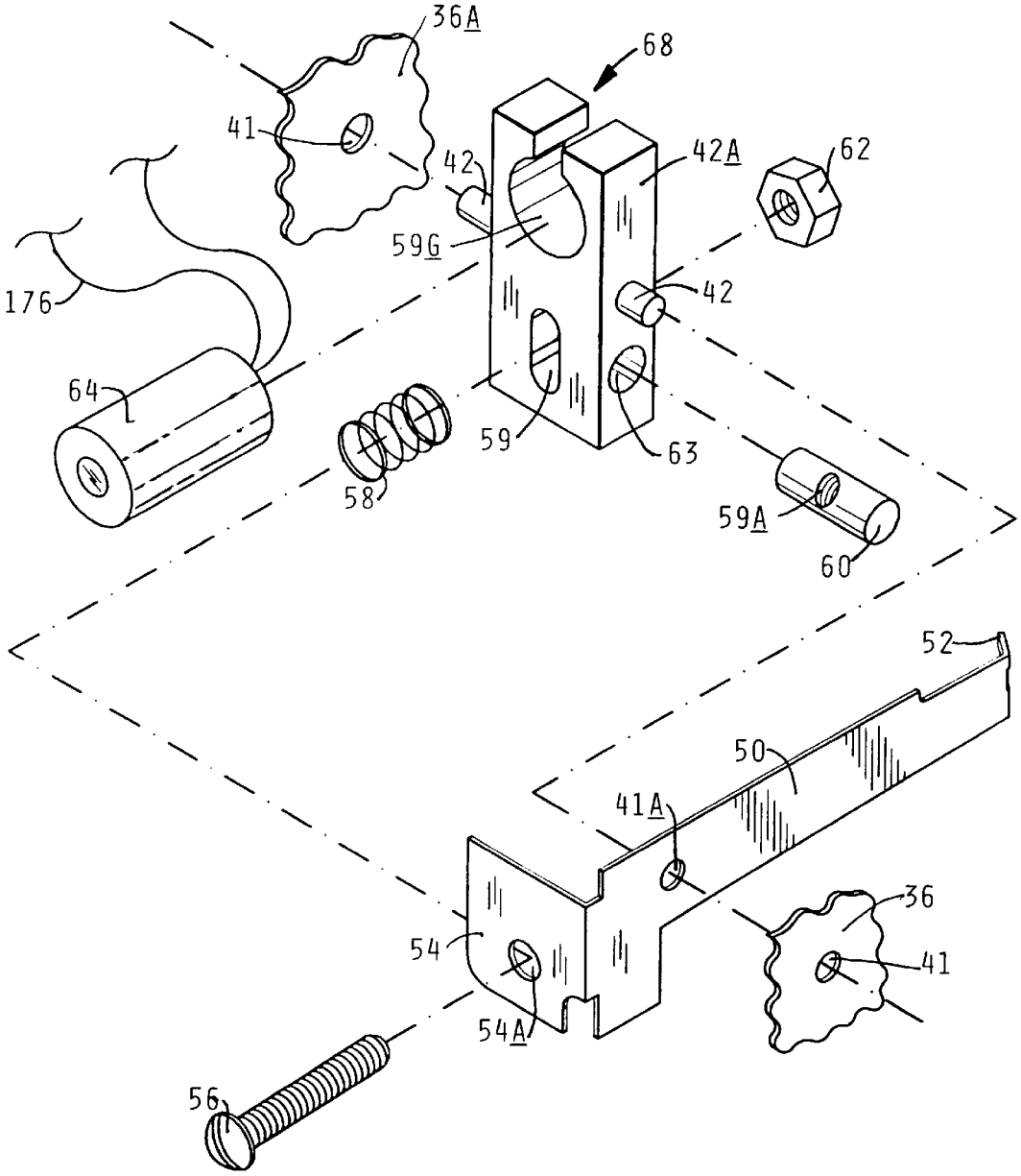

(Noting especially FIGS. 2 and 2A, in the "exploded view" presentations, the limits of the Drawing paper have required a certain "staggering" of axes of presentation, and thus what might appear to be the displacement of certain components; but with that reminder there should be no confusion in interpreting the Drawings in that regard.)

VIII. DETAILED DESCRIPTION OF PREFERRED EMBODIMENT (For hopeful ease of understanding, the textual Description is divided into two parts, i.e., Sec. VIII.a., whose emphasis is on construction details, and VIII.b, whose emphasis is on operativity; however, some inter-relation seems necessary, and thus the two Sections VIII.a and VIII.b are intended to be considered together.)

As of course is well known, the cocking of the apparatus by the user pulling on the bow string,and forward support of the arrow by the user's forward hand,gives an aiming effect to the arrow, the aiming being achieved as the user's forward hand is moved vertically and thus with respect to the rear end of the arrow whose elevation is substantially constant, being a function of the user's height and relative length of his rear arm-sections.

Accordingly, as is of course also well known, the user must elevate his forward hand to achieve a relatively longer arrow trajectory, due to the fact that the user must impart an upward component to the trajectory of the arrow's flight path to compensate for the effect of gravity.

The factors of distance to the target and resilience characteristics of the bow of course are factors which must be accounted for in order for the arrow tip to strike the target by being at the proper vertical height when the arrow has traversed the trajectory to the target.

In the use of the laser sighting unit, the user will look specifically upon the target for the presentation or showing thereon of the laser's "sighting dot", in contrast to the sighting-use of a conventional bow and arrow assembly in which the user would "sight along" the arrow to physically observe the initial inclination of the arrow's trajectory.

Also, in considering the sighting and target-accuracy of this laser-guided sight system, it is assumed that the hunter's skill of aiming will laterally center the arrow and its trajectory sufficiently centrally of its lateral or horizontal trajectory, that the aiming details here discussed relate wholly to the vertical aiming aspect.

The concepts herein are generally shown with respect to archery and its factors of construction and operativity; although the concepts are not limited to archery, and the correlation of archery factors to other weaponry factors should presumably be quite apparent.

VIII.a. CONSTRUCTION DETAILS

As shown in the Drawings, the concepts for the guidance means 13 of this invention are shown in association with a bow 14, the bow 14 having a riser 15, a bow window 16, and a handle 17. FIG. 1 also shows in association with the bow 14 a momentary switch 18 which provides circuitry (FIG. 6, e.g.) to the laser component (64) shown in FIGS. 2,2A,6,7, 7A,8 and 9. Bolts (not shown) connect the guidance means 13 to the bow 14 by passing through aligned holes 19 in the bow 14 and in the guidance means 13's sight bracket (82).

Turning now to the concepts for the guidance apparatus 13 used with the bow 14, they are shown as contained within a framing containment housing 20, which is shown as a rectangular box, part of which is shown as "broken away" in FIG. 1 for better illustration of interior details. The housing 20 is a sturdy framing 20.

The containment housing 20 is provided with circular adjustment slots 22 (See FIG. 2 and other Figures) which are provided for fiber optic light receivers 30 of light receiver assemblies 30A described in connection with their operativity.

A switch 24 is carried by the containment housing 20, which has circuitry 25 (FIG. 6) which leads to the laser diode (64) as described below, circuitry containing battery 25A shown in FIGS. 6,9 and 11.

The bottom wall 20A of the containment housing 20 is provided with a hole 26 which accommodates adjustment as described below for adjusting cam (39) component shown in FIG. 2 and other Figures.

Jam nuts 28 are threaded onto respective light receivers 30 which receive light through fiber optic holders (adjustment tubes) 31 with operativity described below. Three sets of light receiver assemblies 30A are shown, for illustration in FIG. 9 mounted on the containment box 20.

Each light receiver assembly 30A is illustrated in FIG. 11 showing the first large component located or installed in adjustment slot 22, referred to as the "light receiver" because of its position as being the first component of the light receiver assembly 30A to receive light through its interiorally threaded core containing the fiber optic adjustment tube 31.

Other jam nuts 32 are threaded onto the adjustment tubes 31 to jam against the light receivers 30 to hold the adjustment tube 31's adjusted positions Crimp nuts 33 are threaded on the ends of adjustment tube 31 to crimp adjusted tube 31's end against the fiber optic cable's cladding 76 to hold the adjusted position of the fiber optic cables 34.

The window 35 of the containment box 20 is the opening in the forward wall 35A of the containment box 20 for laser beam projection (66) and laser adjustment described below.

Side cover plate 36 is held by screws 38 onto the box 20 on the side of the box 20 opposite to the side wall 36A which contains the circular adjustment slots 22. (FIGS. 2,6,7 and 8)

The side cover plate 36, and its opposed counterpart wall 36A of containment box 20, have a multi-purpose component 40 (shown most clearly in FIG. 11) and providing operativity described below.

Each multi-purpose component 40 comprises exterior male threads 40A which thread into female threads 40B of the box 20's walls 36 and 36A, respectively, providing transverse adjustment described below, of axles 43C and 43D of the pendulum assembly (48), FIG. 11, described below.

That is, transverse movability of the axles 43C and 43D is provided by each of the axles 43C and 43D bearing outwardly against a C-shaped piston member 40C, there being a compression spring 40D bearing inwardly against that piston member 40C and bearing outwardly against the outward wall 40E of each multi-purpose component 40, the springs 40D transmitting the adjustment force by pressing inwardly against the respective piston 40C.

The springs 40D also act as shock absorbers to reduce shock from the bow's recoil due to the high force involved in the arrow projection factors, the spring 40D being interposed between the axles of the pendulum assembly 48 and the multi-purpose component 40 which is connected to the housing 20's wall.

Still noting especially FIGS. 1,7 and 11, the multi-purpose components 40 provide adjustment of the pendulum assembly 48 transverse with respect to the box 20, by twisting either of the multi-components 40; for both of the axles 43C and 43D are connected to the top portion 48A of the pendulum assembly 48 and thus in that sense are connected to one another, the goal of such adjustability being the transverse adjustment movement of the pendulum assembly 48 (FIGS. 1,7 and 11) being to achieve desirably tight (although relatively movable) mating connection of the cam track 39A and arm 50's fingers 52 as may be desired particularly as in assembly or maintenance procedures.

Another function of each multi-purpose component 40 is that its inner wall 40F has a central opening which provides a bearing for the axle 43C or 43D as the pendulum assembly 48 pivots during the maneuvering of the bow and sight combination in the aiming procedure detailed herein.

Such pivoting of the pendulum assembly 48 is provided by there being a freely turning rotational support of axles 43C and 43D (by the central opening in inner wall 40F) and by the fact that most or substantially all of the weight of the pendulum assembly 48 is such that its center of gravity is below the axis of axles 43C and 43D, as will be apparent by noticing (FIGS. 4 and 11) that the cam 39 with its cam track 39A is of light weight (preferably made of plastic) and the lower portion 48G of the pendulum assembly 48 is made of a relatively heavy material (such as metal).

This pivoting in automatic in response to aiming procedures as to the bow 14 through its maneuvering (raising or lowering) procedure, for the pendulum axles 43C and 43D are supported by the multi-purpose components 40 which are connected (even though screw-threadedly) to the housing wall 36/36A.

Cover plate 36 (and its counterpart 36A) also is provided (FIGS. 2,2A and 6) with a pin support hole 41 which serves to support a pin 42 of the laser holder 42A. Pin 42 acts as an axle during actuation described below, the pin 42 being supportively journaled in support hole 41 in cover plates 36 and 36A.

The laser holder 42A, and its most-related parts are shown best in FIG. 2A, the laser holder 42A shown as being an important part of the linkage which ultimately changes the orientation of the laser diode 64.

The hole 41 has its counterpart support opening in the opposite wall of the container box 20, i.e., the side wall 36A containing the slots 22. (See FIG. 6)

In the pendulum assembly 48 there are multiple LED sockets 43 (see FIGS. 3,4, e.g.). In these sockets 43, LEDs 43A are shown by dash lines in FIG. 7 and in FIG. 11 by a single LED 43A in dash lines. The LEDs 43A are provided circuitry 43B (FIG. 11) a portion of that circuitry 43B being contained in vertical channels 48B (FIG. 3), the circuitry 43B leading to the axle 43C and axle 43D, which serve as components of the circuitry 25 through the battery (25A).

The axles 43C and 43D are installed in the top portion 48A (shown in FIGS. 2,2A,3,4 and 11) of the pendulum assembly 48 which LZ consists of a non-conductive material to avoid shorting out electrical circuitry 43B. The LED sockets 43 are provided in the lower portion 48G of pendulum assembly 45.

The axles 43C and 43D which are pressed into the top portion 48A of the pendulum assembly 48 are pressed securely against electrical contacts 25B and 25C thus completing the battery circuitry 25 (see FIG. 11). When the pendulum assembly 48 is installed in the containment box 20 the axles 43C and 43D provide circuitry to the multi-purpose components 40 which completes the circuitry 43B to the battery circuitry 25.

Figure 3A:
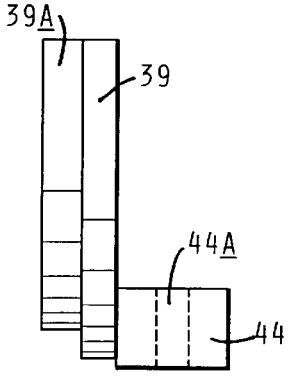
FIG. 3A is a schematic representation of the cam shown in FIGS. 1–4, 7 and 8, the cam being shown in side elevation, with its attached lug.

Another significant concept is the provision of a cam 39 (FIGS. 1,2,3,3A,4,7,8 and 11) whose cam base 44 (FIGS. 3A and 4) has a threaded hole 44A to receive an adjustment screw 46, rotatable to adjust the cam 39 for programming the cam 39 with respect to bow pull force and arrow characteristics, explained further below.

A spring 47 ensleeved about the shaft of screw 46 supplies upward force against the cam 39 by being bottomed against the cam base 44 and a spring nest 49 of the pendulum assembly 48. The effect of this is to hold the screw 46 upward because the screw 46 is threadedly connected to the cam base 44, desirable for cam adjustment explained below.

Turning of the screw 46 clockwise or counterclockwise serves, by its threaded engagement with the non-rotatable cam base 44, to move the cam base 44 and cam 39 upward or downward, causing the cam track 39A to provide an adjustment of the laser holder assembly 68 by controlling the motion of the arm 50 and its fingers 52, the laser holder assembly 68 being more fully described below.

The cam base 44 is a lug of square cross-section so as to be held against rotation by its non-circular nature blocked against rotation by a square wall 45 of the pendulum assembly 48 (See FIGS. 1–3).

A feature of the cam 39 is a cam track 39A in the form of a partial ring protruding from the cam 39, the cam track 39A supporting a laser holder adjustment arm 50, by the fingers 52 of that arm 50 slidably receiving the cam track 39A (See FIGS. 1,7 and 8), the arm 50 and fingers 52 serving as a cam follower of cam 39 for adjustment effects detailed below.

The laser holder arm 50 has its forward end 54 bent 90°, (FIGS. 1,2 and 2A) to provide a transverse wall or ear surface 54 which supports an adjustment screw 56 for effect-explained below.

Noting especially FIGS. 2,2A and 7, as to details of that laser holder arm 50 and its operativity, FIG. 7, those Figures show the laser holder assembly 68 comprising adjustment screw 56, which extends through a clearance hole 54A in the 90° bent ear or tab 94, spring 58, clearance hole 59 in the bottom portion of the laser holder 42A, a threaded hole 59A in horizontal adjustment pin 60 when it is inserted into horizontal hole 63 (a free fit therein), lock nut 62, axle pivot pin 42, laser holder 42A, laser holder adjustment arm 50, laser receiver hole 59G, and laser diode 64 in hole 59G which projects a laser beam 66 outwardly of box 20 through its forward wall window 35 of front wall 35A.

The spring 58 bottoms against the back side of tab 54 and bottoms against the front side of laser holder 42A. Tab 54 is stationary, however, because the hole 41A in holder arm 50 receives and is thus located by the horizontal pivot pin 42 which is received and located by hole 41 in containment housing wall 36 and 36A; and thus any compressive bias in the spring 58 pushes against the front side of the laser holder 42A to cause the holder 42A to pivot about its axle pin 42, the amount of such pivoting being controlled as a function of the adjustment of the screw 56 in pin 60's female threaded hole 59A as blocking continuation of pivoting of the laser holder 42A. Such bias in spring 58 is thus controlled by the rotational adjustment of screw 56 which is freely fit in holes 54A and 59.

With the laser holder assembly 68 mounted in the containment housing 20, the assembly 68 can be adjusted to allow the laser holder 42A to adjust forward or backward by rotating the adjustment screw 56.

There are two angular adjustments of laser 64 and its laser beam 66 which are provided by rotating the control screw 56 of the laser holder assembly 42A, one being a forward adjustment and the second being a rearward adjustment, which indirectly adjust the laser beam 66, by adjusting the orientation of the laser support holder 42A as to its rotational setting about the axis of transverse support pin 42, which correspondingly adjusts the angular setting of laser receiver hole 59G and thus the laser device 64, because of the laser device 64's tight fit in the receiver hole 59G.

With the threads of adjustment screw 56 extending through pin 60's hole 59A inadvertently to the back side of laser holder 42A, lock nut 62 is installed on the end of the adjustment screw 56 to act as a safety stop to keep the screw 56 from being backed out of the adjuster pin 60.

As to the fiber optic components concepts and details, in addition to the laser guidance features, the features provide for the archer the advantage of a second feature sighting device, most particularly useful when the laser's "sight-dot" cannot be seen on occasions when the sun's brightness overcomes the laser beam.

Although fiber optic features have been used in constructions in which fiber optic features are attempted to be used in providing the archer with an improved sighting means over the prior art of a standard sight pin, the fiber optic constructions of the prior art as known to the Inventors are of scintillative type in which ambient light in nature in collected by the scintillative cable and intensified by collection of light through and along its length and transferred to the ends of the fiber optic cables, with a direct result of the ends of the cable showing a high brillance of illumination.

With that prior art type of fiber optics use, the archer uses that brillantly lit end of the fiber optic cables as a sighting guide (sighting pin dot) compared to a standard sight pin, and the fiber optics improvement provide the archer with a sighting means by which sight dots or sight pins are visibly seen longer in the evening as sunlight is reduced. Such prior art use is built upon by the present invention's concepts, which diverge from the prior art in the important feature of this invention's use of novel particulars of the construction and use of a sealed light chamber 70 and other details.

In other words, noting especially FIGS. 7,9 and 12, the sealed light chamber 70, comprising a light output source 72 in this invention, is provided non-clad scintilative fiber optic cable 74 extending through the sealed chamber 70 which is exposed to the controlled light output source 72. This light output source 72, when energized, provides intensified light, in which the fiber optic cable 34 ends glow more brilliantly than what normal ambient light provides.

This greater intensified and controlled feature and other light source details in this invention provide the fiber optic features in this invention, the ability to overcome the disadvantage of bright light conditions, regardless of normally uncladded fiber optics normal ability to be seen in low light conditions, in which is voided by this invention's concept of using a cladding 76 over the fiber optic cable 34, on the fiber optic portion outside the sealed light chamber achieving a 100% control of all light used in this sighting device.

Standard sight pins have considerably less illumination in low-light conditions compared to the scintillative fiber optic nature of collecting light in low light conditions; and this contrast shows the advantage expected and obtained by the use of a special type of scintillative optic cables according to the present concepts.

Accordingly, as shown in the Drawings and as herein described, the special type of fiber optics of the present invention are set forth in contrast to such prior art as well as to detailed features and components themselves.

More particularly, as to the features of the present invention, fiber optic cables 34 (FIGS. 9 and 11) receive light from the LEDs 43A, through the ends of the fiber optics which are installed in the light receivers 30, the fiber optic cables 34 continuing as shown and exiting the light receivers 30 and leading tothe sealed light chamber 70 of housing 20 after entering the box 20.

The light chamber 70 contains an independent light source 72 (FIGS. 6,7,8 and 9) for an optional use described below.

The fiber optic cables 34 are shown schematically as entering the sealed light chamber 70 in FIGS. 7 and 9; but their pathway is shown more completely in FIG. 9 as including a partial interim portion 74 in which the cladding 76 has been stripped. Exteriorly of the sealed light chamber 70 the cables 34 are clad 76, i.e., coated with light fibrous insulation 76, providing that no ambient light may enter along the exterior length of the fiber optic cables 34 which would embellish the light coming from the light receiver assemblies 30A.

The fiber optic cables 34, after exiting the sealed light chamber 70 through wall 36A, continue to the light output assemblies 80 which are received by the lower part of sight bracket 82 in vertical adjustment slots 84, the slots 84 accommodating vertical changes of the position of light output assemblies 80 with their respective sight pins 78 which achieves alignment of sight pins 78 to respective targets and their use respectively.

The light output assemblies 80 are shown in FIGS. 1,2,9 and 12. The fiber optic cables 34 are axially received respectively by a light output adjustment tube 86. The cladded fiber optic cables 34 extend to the center portion or area 88 of the light output adjustment tube 86. This center area 88 is a light transfer and adjustment chamber 88 to adjust light transfer (bright to dim or dim to bright) by simply loosening crimp nut 96 on the flexible fiber optic end of adjustment tube 86; then the shooter can dim or brighten the sight pins 78 by either pulling the cable 34 farther out or pushing the fiber optic cables 34 in, respectively. The crimp nut 96 can be re-tightened to maintain that adjustment.

Still noting FIG. 12 especially, the light output adjustment tube 86 also holds and maintains adjustment of sight pins 78. The sight pins 78 are held securely in the adjustable tube 86, and also is rotational about its own axis (which is the same as the axis of the light output adjustable tube 86), by loosening the crimp nut 100 and then re-tightening the crimp nut (100) after the desired adjustment is made.

The outer portion of sight pins 78 are desirably made of a rigid cladding 102 to maintain a bent shape as well as to provide a light shield cladding effect. The interior portion 104 of sight pins 78 is formed of fiber optic material 104, coated with a rigid cladding 102.

Still noting FIG. 12, the light output adjustable tube 86 is threadedly installed in adjustable tube holder 90 which is received in one of long vertical adjustment slots 84 in sight bracket 82 (See FIGS. 1,2,6 and other Figures), the slot nature of the openings 84 accommodating vertical adjustment for vertical placement as well as a means to give space to add several sight pins 78 to achieve further range-distance capabilities.

Each adjustable tube holder 90 is a tube whose core is threaded to accommodate the adjustable tube 86, and holder 90 is secured in its position in the slots 84 by a jam nut 92 which presses against a fiber lock washer 93.

Supplementing the laser and fiber optic concepts of this overall invention, a novel and advantageous adjustment base 106 provides laser alignment adjustment of the laser 64 and its laser beam 66, in addition to its provision of a battery compartment 108 serving the electrical needs of the system 13.

Alignment concepts as now detailed refer to windage adjustment. Windage adjustment is a factor of horizontal concern in contrast to vertical adjustment as to gravational effects.

Windage adjustment provides the shooter a means to adjust the sight left or right to control a projectile's left or right shot placement to obtain an accurate hit on the target.

The windage-considered alignment of the laser diode 64 and its laser beam 66 is very desirable, as it is important to be able to properly align an archer's arrow or a projectile's flight path, horizontally as well as vertically.

As now shown, this in a vital horizontal adjustment and is advantageously made by the following mechanism which achieves a controlled horizontal arc adjustability of the laser device 64 and to the adjustable base 106, the adjustment of those two factors achieving the precise vertical alignment regardless of the arrow or other projectile's shooting positions of a shooting device.

Such controlled horizontal adjustability is provided at each of two stations 107 which are spaced along the adjustable base 106. Horizontal arc adjustment provides the movement to align a projectile and a laser as needed to achieve adjustment of alignment to aim to several targets in a projectile's flight path, whereas the prior art of windage provides adjustability to only one distant target if a projectile center shot is not present.

Noting FIGS. 2 and 10, especially, there is shown the adjustment base 106 connected to the upper portion of sight bracket 82, as particularly shown in FIG. 10, as to each one of two portions or stations 107 of base 106. A control screw 110 having a head 112 is installed (leftwardly in FIG. 10) freely through a large-bore threaded hole 113 at the right side (right in FIG. 10) of the base 106. (The particulars as to the hole 113 are given below.)

Each of the two control screws 110 and its corresponding hole 113, and the related hardware of each as now mentioned, provide a basis for one of two adjustment stations 107, indicated as to both in FIG. 2 although only one is shown in FIG. 10.

Although there are two sets or stations 107 of adjustments, each with its control screw 110, etc., in a less expensive embodiment it may be desirable to replace one set by giggly some sort of a pivotal connection; and even more economically it may be desired to replace both of those sets of adjustment details by an optionally usable plurality of spacers to attain the desired relative spacing of the box 20 and the adjustment base 106 with respect to the sight bracket 82 to thus achieve windage control.

After passing (leftwardly) through the base 106's hole 113, the control screw 110 freely slides through a clearance hole 114 of a rotatable cylindrical screw retainer 116, the screw retainer 116 being installed into a round retainer socket 118 in the adjustment base 106, at each of its adjustment stations 107.

The retainer 116 retains the horizontal position and the rotational position of the control screw 110, accommodating the relative rotation of the screw 110 while giving support to the adjustment assembly features.

The end 119 of the screw 110 opposite its head 112, in moving to its position shown in FIG. 10, passes (leftwardly) through a large clearance hole 120 at the side face (left) of the adjustment base 106.

The screw 110 is aligned with a threaded hole 122 of the sight bracket 82; and the control screw 110 is finger started into the threaded hole 122. Control of screw 110 is provided preferably by an Allen head wrench socket in the head of screw 110.

In use, the control screw 110 is rotated (clockwise) until screw head 112 of screw 110 rests (at 123) against the right face of the screw retainer 116, and the base 106 is forced tightly against sight bracket 82 by the engagement of the threads on screw 110 and the female threads of sight bracket hole 122.

It will be noted that a sufficient length of threads at the leftward end 119 threadedly extend through the sight bracket 82 and its holes 122 to receive adjustment control knobs 124 onto the free ends 119 of each of the control screws 110.

After installation of each control knob 124, a set screw 126 is threaded into a small-bore threaded hole 128, and set screw 126 is forced against the screw 110's threads to maintain the control knob 124's position.

At the opposite (right) end (as shown in FIG. 10) of each adjustment set of 107 of base 106, a large set screw 130 is rotational threaded into the large-bore threaded hole 113 until the set screw 130 loosely touches the socket head 112 of the control screw 110 (although that touching is not shown in the position of set screw 130 in FIG. 10).

In this position, the screw head 112 of control screw 110 is between the rotatable retainer 116 and the set screw 130.

The control knob 124 is turned (clockwise) rotating the screw 110 (clockwise) which forces the head 112 of control screw 110 to push (rightwardly) against the set screw 130, with a direct result of the base 106 being forced to move rightwardly from the bracket 82.

With base 106 adjusted rightwardly from the sight bracket 82, by rotation of one or both control screws 110, a space 125 will exist between the end face 121 and the sight bracket 82. If further adjustment is desired one or both control screws 110 are now to be rotated to create whatever spacing 125 is desired to achieve alignment as required, more fully explained below. Any spacing adjustment at either station 107 of a control screw 110, etc., will vary the relative spacing between the sight bracket 82 and the adjustment base 106.

The adjustment base 106 can be adjusted rightwardly or leftwardly as desired to align the sight laser 64 (and the laser beam 66) vertically parallel with an archer's arrow or firearm projectile tube and its projectile.

The fine adjustability which is achieved by being able to adjust one or both adjustment stations 107 is particularly important, and must be individually considered, for each bow and projectile characteristics are likely to be significantly different.

Miscellaneous hardware is shown in various Figures of the Drawings.

For example, the containment housing 20 as shown is hinged by a lug 140 that is located on the lower front 35A of the containment housing 20, the lug 140 being provided with a horizontal hinge pin hole 142 which aligns with two other horizontal hinge pin holes 144 on the front 141 of the base 106. A slot 146 on the front 141 of the base 106 receives the lug 140. The hinge pin holes 142 and 144 are aligned, and an axle pin 148 is installed through the hinge pin holes 142 and 144 coupling the containment housing 20 to the base 106. (FIG. 5, especially)

On the rear 149 of the base 106 another slot 150 is provided to receive a latching device 152 that provides a horizontal hinge pin hole 154.

The latching device 152 mates with the slot 150 and the pin hole 154 is aligned with horizontal pin holes 156 on the rear 149 portion of the base 106. A hinge axle pin 158 is installed into the hinge pin holes 154 and 156 which couples the latching device 152 to the base 106. On the rear 149 portion of the containment housing 20 a slot 160 is provided to latchingly receive the latching device 152 into the slot 160 which securely provides and maintains a closure of the base 106 to the housing 20.

Such easy openability is particularly advantageous for battery replacement and adjustable alignment procedures. This easy openability feature aids the user to test and adjust the sight device means 13 needed to make certain the sight device means 13 and the laser diode 64 are in vertical alignment with a projectile or a projectile tube 170.

Turning now to other embodiments which incorporate the inventive concepts, attention is called to FIGS. 13,14 and 15 as general views embodying the concept, and particularly with reference to similarities of use of the present concepts, on various types of weapons and projectile throwers.

As shown in FIG. 13, the sighting apparatus 13 is mounted onto a bow 14 as described in detail herein.

In contrast to FIG. 13, FIG. 14 shows the novel concept of the sighting apparatus 13 embodied in a cross bow forearm stock sight mount handle 162, and more particularly on the underside, the underside being under the weapon's rail 164 (the rail 164 providing a resting support 166 or firing ramp support 166) for a bolt to be fired referred to as a "cross bow arrow". The bow portion of a cross bow is mounted crosswise to the rail frame.

That underside nature of the mounting of the sight 13 in FIG. 13 embodiment, the forearm stock sight mount handle 162 is provided with a recessed underside pocket area 168 to accommodate the sighting apparatus 13.

Likewise, as to the FIG. 15 embodiment, the sight 13 in the FIG. 15 embodiment is also mounted in a forearm stock sight mount handle underside pocket 168 which is on the underside of the weapon's projectile tube 170.

VIII.b. OPERATIVITY DETAILS

This Section supplements the other descriptions, to the extent that operativity can be shown favorably as a supplement:

(1) Momentary switch 18:

The momentary switch 18 is shown in FIG. 1 and is embodied in circuitry 25 and 176 shown in other Figures, for example, in FIG. 6. The momentary switch 18 is biased to open-circuit condition, and leads to the external power jack 172 shown in FIGS. 6,7 and 8 with two terminals 174, one terminal 174 leading to the battery 25A by circuit 25, and the other terminal 174 leads to the laser circuitry 176 described below.

The effect and operativity of the momentary switch 18 is to make the laser circuit 176 temporarily energized when the shooter desires to achieve the temporary illumination of the laser beam 66; this is by closing the circuit across the terminals 174 of the jack switch 172.

(2) External dual-purpose power jack 172:

Powered by the battery circuit 25, the power jack 172 leads to the laser circuit 176 which circuit energizes the laser diode 64, and the circuitry 176 is shown as leading to the left one of the switch terminals of switch 24. Switch 24 is shown (FIG. 6) as a single-pole double-throw switch in which the left terminal indicates the input terminal for the laser circuitry 176 and includes the momentary switch 18 shown in FIG. 6 as one of the features of the circuits 25 and 176. The right terminal indicates the input terminal for the LED circuitry 43B shown more clearly in FIG. 11.

The effect of energization of laser circuit 176 is to cause the laser diode 64 to emit the laser beam 66, for as long as the momentary switch 18 is in circuit-closing position.

The external power jack 172 accommodates the use of an external power source (not shown) for a reduced-cost embodiment which omits the built-in battery compartment 108 and its battery source 25A and the momentary switch 18; and thus it is referred to herein as a dual jack 172.

(3) The pendulum assembly 48:

The pendulum assembly 48 of FIGS. 1,3,4,7 and 8 comprises LEDs 43A and the LED circuitry 43B which is installed onto the lower portion 48G of the pendulum assembly 48.

Noting FIG. 11, the axles 43C and 43D serve two purposes, i.e., one purpose being that each axle 43C and 43D is in series with LED circuitry 43B and battery circuitry 25 thereby energizing the LEDs 43A when the switch 24 is turned "on" at the right terminal of the switch 24 in FIG. 6.

The other purpose of those axles 43C and 43D is to provide rotational support of the pendulum assembly 48, rotational with respect to the housing 20, for operative purposes of holding the cam 39 always in a constant orientation with respect to the earth and to the housing 20 by the pendulum effect noted above of the difference in the weight and shape factors of the two portions 48A and 48G of the pendulum assembly 48.

The corresponding relative rotation of the housing 20 and bow 14 with respect to the pendulum assembly 48 and its cam 39 provides the functions now explained as to each of the laser and the fiber optic functions.

(4) Relative rotation of pendulum assembly 48 serves laser function:

The relative rotation of the housing 20 and bow 14 with respect to the cam 39, the cam 39 being affixed to the pendulum 48, causes the arm 50 of the laser holder assembly 68 to follow, by arm fingers 52, the cam track 39A; and it is that slight rotational movement of holder arm 50 about the axis of axle pivot pin 42 which (by the linkage particularly shown in FIG. 2A) is operative to set or change the orientation of laser diode 64 with respect to the housing 20.

As a shooter is aiming and maneuvering a shooting device embodying the present concepts, his judgment of distance is not required to be good; the orientation of the housing 20 aids the sight system 13 to achieve its range adjustable feature.

That is, as the box 20 rotates about the pendulum assembly 48, with corresponding relative rotation of pendulum assembly 48 about the box 20, a direct result is the cam track 39A sliding through the fingers 52 of the holder arm 50; and the result is that the laser 64 and its holding assembly 68 (FIGS. 2A, 7 and 8) automatically rotating about the axis of axle pin 42, emitting its laser beam 66 at the desired target regardless of its distance (although of course within the capabilities of the weapon and its projectile combinations).

As this rotation of the housing 20 and bow 14 occurs, relative to the laser 64, the laser 64 is range adjusting with each increment of rotation of the laser holder 42A to automatically change the relative orientation of the laser 64 adjusting to a correct angle, emitting its beam 66 to a desired target.

This automatic vertical adjustment which is achieved by the relative rotation of the pendulum 48 (and cam 39, fingers 52, arm 50), is a second type of laser vertical adjustment, the first being the manual adjustment achieved by manual rotation of control screw 56.

These adjustment features enable the shooter to need only to release his projectile when the laser beam 66 is visible on the target, considering here only the vertical adjustments required by gravity. Horizontal adjustment is explained as discussed below.

(5) Relative rotation of pendulum assembly 48 serves fiber optic functions:

In addition to serving the function of the laser beam 66 direction, the relative rotation of the housing 20 and bow 14, with respect to the pendulum assembly 48 (and cam 39) serves (see FIGS. 6,7,8 and 11) as a light transfer function explained below.

That is, assume (FIGS. 6 and 11) that the LEDs 43A have been energized by switch 24 through circuitry 25 and 43B, emitting light by that energization.

The light receivers 30 installed into the circular slots 22 of housing 20 are positioned in one or more circular paths 22 about the axis of the axles 43C and 43D of the multi-purpose component 40 in the walls 36 and 36A.

Two of the light receiver paths (slots) 22 are shown here for illustration.

They are both arcs of circles concentric to the axis of axles 43C and 43D, and the light receiver arcs 22 have the same radii as the distance of the respective LEDs 43A from the center of the axles (shown in FIGS. 7,8 and 11) from the center of the arc slots 22 and the axis of the axles 43C and 43D.

As the box 20 rotates, carrying the light receivers 30 for rotating toward or past the LEDs 43A, the LEDs 43A transfer light to each light receiver 30 one at a time at different angles of the box 20's rotation about the axis of axles 43C and 43D; and the fiber optic sight function acts as an automatic function to provide range finding capabilities.

Light receiver assemblies 30A can be taken out or more can be installed and moved about as desired by the access holes 178 in line with the slots 22 and slightly larger to accommodate the installation and/or removal of light receiver assemblies 30A.

Automatic range finding capabilities and automatic functions are explained below.

As the box 20 rotates, and a shooter is raising or lowering his shooting device, the light receivers 30, which are installed in the slots 22 of wall 36A of the rotating housing 20, will rotate toward of past LEDs 43A installed in sockets 43 in the lower portion 48G of the pendulum assembly 48.

The LEDs 43A will emit light to the light receivers 30, and the fiber optic cables 34 in the adjustment tube 31 accumulate the received light and transfer it to the sight pins 78. The sight pins 78 will light up one at a time (in the sight's automatic function) and the shooter will use the brillantly lit shining light pins 78 sequentially as his sighting guide 78 to align between the shooter's eye and his desired target.

The shooter needs only to aim his shooting device and align the only sight pin 78 shining and this sight pin 78 being aligned with the desired target, the shooter fires his shooting device's projectile to achieve an accurate shot placement.

The fiber optic feature addition to this sight system is important, that is, this feature expands the capabilities of the sight system to use several sight pins 78 to achieve farther distance capabilities of the sight system 13, as well as achieving a sight feature when the laser beam cannot be seen upon a desired target in the bright light conditions.

These examples are few of many reasons why this fiber optic addition advantageously supplements the laser features of the sight system 13. The laser 64 feature is limited to range-distance limits because of weaponry and projectile characteristics and combinations correspondingly. It must be understood that different weapons of greater force would increase the limits of range distance of the sight system 13, and weapons of lower force would decrease limits of range distance.

(6) Horizontal adjustment achieved by stations 107 of the base 106, etc.:

Horizontal (windage) adjustment is achieved mainly by the features shown in FIG. 10, with various components having reference numerals 106 through 130.

Briefly summarized to show the ease of horizontal adjustment, the control screw 110 is turnable through its head 112 to vary the spacing 125 between the sight bracket 82 and the adjustment base 106.

More particularly, the spacing 125 is achieved by adjusting either or both of the two stations 107 as described above.

(7) Changes in laser beam characteristics, and test proecdures for vertical alignment:

As a desired supplement to the other concepts, preferably in combination with one or more of them, the laser diode 64 is desirably made with an adjustable lens unit 180 to adjustably produce an expanded target reflection dot.

The concept of adjustability of beam 66 as per adjustment lens 180 is shown here schematically in FIGS. 7 and 7A, however, for various mechanisms for altering the size and/or shape of a projected beam are already well known except that no combination of an adjustable lens unit for a larger target dot of laser illumination is known to the Inventors, and the laser art seems accordingly to consistently continue to desire to shrinken the laser beam to achieve the extreme longer distance, in present laser art, and the desired shrunken beam 66 is in contrast to any possibility of enlarging the beam 66 in the art of laser guidance.

Operativity of the laser beam 66 alignment is achieved by energizing the laser 64 and aligning it with an arrow or other projectile, moving the containment box 20 in its vertical rotational path about the hinge connection pin 144. The vertical rotational movement is illustrated in FIG. 5. Adjustment and test procedures are now explained.

With the laser energized, when utilizing adjustment procedures, the shooter rotates the containment box 20 hinged about the axle pin 144, and moves it in its 90° (FIG. 5) limited path, observing and adjusting the laser beam 66 to be aligned with the center or axis of an arrow or a projectile tube 170, by transversely adjusting the adjustable base 106, by the manual manipulation of one or both of the adjustment stations 107 provided in the base 106.

The centering is achieved by adjusting the adjustment base 106 transversely in a direction to move the laser beam 66 or to the center of an arrow or projectile tube 170 as needed.

Several adjustments or movements of the base 106 may be required to achieve a fine tuned horizontal adjustment.

IX. SUMMARY OF ADVANTAGES

The present invention as detailed herein has advantages in both concept and in component parts and features; for in contrast to other articles known to the Inventors as to the prior art the invention provides advantageous features which should be considered, both as to their individual benefit, and to whatever may be considered to be also their synergistic benefit toward the invention as a whole:

a. Extremely accurate for precision shooting;

b. Even novices and youngsters can show great skill in marksmanship, and even experienced marksmen can improve;

c. Ability to easily and quickly adjust for differences in distance, elevation and ambient light conditions;

d. Adjustability for various shooting apparatus factors and their special needs;

e. Advantages without contrasting disadvantages;

f. Ability to range adjust and range indicate distances;

g. Adaptable to various kinds and natures of weapons;

h. Provides special advantages of use to handicapped sportsmen; and i. Although technically sophisticated itself, the sight unit is readily assembled as a manufacturing operation, and is quite easily used by the shooter.

X. CONCLUSION

It is thus seen that a shooting attachment sight piece, used according to the combination of inventive concepts and details herein set forth, provides novel concepts of a desirable and usefully advantageous article, yielding advantages which are herein set forth.

In summary as to the nature of the overall articles' advantageous concepts, their novelty and inventive nature is shown by novel features of concept and construction shown here in advantageous combination and by the novel concepts hereof not only being different from all prior art known, even though other aiming attachments for bow and arrow assemblies and for rifles and shotguns have been known and used for scores of years, but because the achievement is not what is or has been suggested to those of ordinary skill in the art, especially realistically considering this as novel combinations comprising components which individually are similar in nature to what is well known to many persons, surely including most of the many makers of weapon apparatus for a great number of years throughout the entire world.

No prior art component or element has even suggested the modifications of any other prior art to achieve the particulars of the novel concepts of the overall combinations here achieved, with the special advantages which the overall combination articles provide; and this lack of suggestion by any prior art has been in spite of the long worldwide use of various types of shooting equipment.

The differences of concept and construction as specified herein yield advantages over the prior art; and the lack of this invention by the prior art, as prior art combinations, has been inspite of this invention's reasonable operativity the and construction once the concepts have been conceived, in spite of the advantages it would have given, and in spite of the availability of all of the materials to all persons of the entire world.

Quite certainly this particular combination of prior art details as here presented in these overall combinations has not been suggested by the prior art, this achievement in its particular details and utility being a substantial and advantageous departure from prior art, even though the prior art has had similar components for numbers of years. And particularly is the overall difference from the prior art significant when the non-obviousness is viewed by a consideration of the subject matter of this sight device as a whole, as combinations integrally incorporating features different in their combination from the prior art, in contrast to merely separate details themselves, and further in view of the prior art of shooting apparatus articles not achieving particular advantages here achieved by this combination.

Accordingly, it will thus be seen from the foregoing description of the invention according to the illustrative embodiments, considered with the accompanying Drawings, that the present invention provides new and useful concepts of novel and advantageous articles, possessing and yielding desired advantages and characteristics in formation and use, and accomplishing the intended objects including those hereinbefore pointed out and others which are inherent in the invention.

Modifications and variations may be effected without departing from the scope of the novel concepts of the invention; accordingly, the invention is not limited to the specific embodiments, or form or arrangement of parts herein described or shown.

What is claimed is:

1. A weaponry sight device for an associated weaponry, the sight device comprising:

a framing means for support by the associated weaponry;

the sight device comprising components including:

a pendulum means;

a first support axle means supporting said pendulum means, and said axle means is supported by the framing means for relative motion of the pendulum means with respect to the framing means;

a cam means movably supported by the pendulum means for vertical motion with respect to the pendulum means;

a first manual adjustment means supported by the pendulum for moving the cam means with respect to the pendulum means;

a laser means, a laser holder means; and an arm means; the said laser holder means being provided with a second axle means, which provides support for the laser holder means and the arm means with respect to the sight device framing means;

a second manual adjustment means to adjust the laser holder means position, with respect to the framing means, thereby adjusting the orientation of the laser means being held by the laser holder means, in a combination in which the second manual means comprises a control screw means operatively connected to the laser holder means, the second axle means rotatably supporting the said laser holder means and also supporting the arm means with respect to the framing means, the arm means providing a means to follow the cam means so as to provide that when the control screw means is adjusted the laser holder means moves with respect to the framing means thus adjusting the orientation of the laser means with respect to the framing means.

2. The invention as set forth in claim 1, in a combination including a spring means, and is provided with two clearance holes, one of which holes extends through the arm means, and the other hole extends through the laser holder means and the spring means, the spring means providing outward tension between the arm means and the laser holder means, and an adjustment pin means which is provided with a tapped hole, which threadedly receives the control screw means, and in which the adjustment pin means is provided access through a horizontal hole which is provided in the laser holder means, said adjustment pin means being slidably received in said horizontal hole allowing said asjustment pin means to move in the said horizontal hole when being adjusted by the control screw means with respect to the laser holder means and the laser holder means' axle pin means.

3. The invention as set forth in claim 1, in a combination in which the relative rotational motion of the pendulum means, with respect to the framing means, will carry the cam means to rotate about the axis of rotation of the pendulum means, thereby providing automatic adjustment of the laser holder means and the laser means, with respect to the framing means, without the use of the control screw means.

4. The invention as set forth in claim 1, in a combination in which there is/are provided one or more light output source means units in the pendulum means, capable of emitting light;

and there is/are provided one or more fiber optic receiver means units in the framing means, and it/they is/are arrangeable in slot means provided in the framing means to receive light emitted from a respective light output source means unit, of the pendulum means, at a selected one of a plurality of locations in the slot means, in a combination in which the plurality of locations are provided by the provision of at least two slot means, both of which slot means are concentric about the axis of rotation of said pendulum means.

5. The invention as set forth in claim 4, in a combination in which a means is provided for conveniently installing and removing the fiber optic light receiver means units, in which the slot means is/are provided with at least one portion which is larger than the remainder of the slot means.

6. The invention as set forth in claim 4, in a combination in which there is provided a light output source means and a light receiver means, in which fiber optic cable means is operatively connected to the sight means to energize a light output assembly means, in which the pendulum means is provided to carry the light output source means for emitting light which is receivable by the light receiver means to energize the light output assembly means.

7. The invention as set forth in claim 6, in a combination in which there is provided a power source means and circuitry leading therefrom to the light output source means, said circuitry comprising a portion including a switch means and a portion which is provided by connections to the said support axle means of the first support means of the pendulum means, thereby to complete a circuit through the pendulum means to the power source means, in spite of the movement of the pendulum means.

8. The invention as set forth in claim 7, in a combination in which the circuitry also includes a portion which is connected to the first support axle means, using that portion for electrical conductivity through the support axle means of the pendulum means.

9. The invention as set forth in claim 7, in a combination in which a portion of the pendulum means is provided to be made from a non-conductive material, and the support axle means is connected to the said portion, providing the said support axle means to be an electrically operative component of the circuitry.

10. The invention as set forth in claim 1, in a combination in which the framing means is comprised of at least three sections, a first one of which sections carries the laser means, the laser holder means, the arm means, the pendulum means, and the cam means;

and the second one of said sections is a support base means which carries the said first section, and supportively mounts to the said third section, the third section being a mount support bracket means, which supportively mounts to the associated weaponry; and said weaponry carrying an associated projectile;

the first one of said sections and said second one of said sections being interconnected by a connection means and secured against relative rotation by a latch means, the connection means accommodating vertical relative rotational movement of the first section with respect to the third section, which said first section provides a means for checking relative alignment of said first section and the laser means, with respect to the projectile being carried by the weaponry, or a projectile tube carrying the projectile.

11. The invention as set forth in claim 10, in a combination in which the adjustment of alignment is provided by the provision of at least two stations which are spaced along the second (third) section, each of which stations provides manual horizontal windage adjustment of the first section and the second section with respect to said third section.

12. The invention as set forth in claim 11, in a combination in which there is provided a control screw which is screw-threadedly connected to a portion of the third one of said sections;

the control screw having a screw head adjacent one of its ends, and a control means adjacent its other end;

the screw head operatively bearing against a portion of the second section, such that manual movement of the control means changes the relative position of the second section with respect to the third section.

13. The invention as set forth in claim 12, in a combination in which the operative bearing of the screw head against the second section is through a retainer piece provided in a socket formed in the second section.

14. The invention as set forth in claim 1, in a combination in which the framing means carries the first support means supporting said pendulum means, the pendulum means having light output means, first support means also comprising a pair of diametrically opposed mechanisms connected to the framing means;

each of said mechanisms including adjacent its inner end a bearing for rotatably supporting one of said pendulum support axle means axles, each of said mechanisms also having an outer wall means;

each of said mechanisms containing interiorly a piston means which is slidable along said mechanisms' interior;

and each mechanism also including a compression spring which is bottomed respectively between the piston means and the outer wall means for providing sufficient contact pressure to the end portions of the pendulum axle means axles to operatively provide electrical conductivity to the pendulum light output means.

15. The invention as set forth in claim 1, in a combination in which the laser means emits a laser beam which achieves a reflection dot on a target;

and in which there is also provided a lens means for said laser means which emits the laser beam, and in which there is provided beam-changeable means by which the user may optionally change the nature of the laser beam's reflection dot.

16. A forearm stock means for a laser sight means for associated weaponry, the forearm stock means providing support for the laser sight means interiorly of the forearm stock means, the forearm stock means being operatively supported by the associated weaponry's lover section, operative to support and guide the weaponry correspondingly supported by the forearm stock means.

17. The invention as set forth in claim 16, in a combination in which the weapon has a rail which provides a frame to which the forearm stock means is operatively supported.

18. The invention as set forth in claim 16, in a combination in which the forearm stock means operatively supports the top portion of the weapon, and in which the support of the laser sight means to the weapon is by an operatively adjustable support of the laser sight means to the forward section's interior of the forearm stock means.

19. A weaponry sight means, comprising:

a framing means for support by the associated weaponry;

a pendulum means;

first support means supporting said pendulum means for relative rotational motion in an arcuate path with respect to the framing means;

in a combination in which there is provided a light output assembly, which includes a sight pin means element for optical alignment with the associated target being used, and means supporting the output assembly, and in which there is provided a light receiver supported by the framing means, and also provided an electrically energizable light output means source which is carried by the pendulum, and which said light output means illuminates the light receiver in an arcuate path corresponding to the arcuate path of the pendulum;

there being provided a fiber optic cable means, carried by the light receiver and leading to the light output assembly means to transfer light through the light output assembly means which holds a sight pin;

in a combination in which the light output assembly comprises a tubular member means having inserted in the inlet end thereof a cladded fiber optic cable means;

and in which there is provided adjustment means for varying the illumination of the fiber optic cable means being transferred to the sight pin for varying illumination being emitted from the fiber optic cable therein.

20. The invention as set forth in claim 19, in a combination in which the framing means is provided with a sealed light chamber means, and in which the fiber optic cable means has portions thereof which are respectively clad and unclad;

the fiber optic cable being of scintilative nature, and the cladding being operative to minimize the effects of ambient light and the other portion of the cable means being uncladded to operatively achieve a substantially brighter light output when the uncladded portion is exposed to an electrically energized controlled bright light source;

the unclad portion being within the sealed light chamber means and the clad portion being generally outside the light chamber means;

the light chamber means providing a controllable electric energized light output source means for intensely illuminating the unclad portions of the fiber optic cable within the said chamber means.

21. The invention as set forth in claim 19, in a combination in which the light output assembly comprises a tube means which receives fiber optic cable means through one of the tube means' ends;

the sight pin being inserted into the other end of the tube means, said tube means being supported by the framing means;

and there is also provided an adjustment means varying the length of said assembly, to move the sight pin for its effect of sight alignment, with respect to a selected target.

22. The invention as set forth in claim 19, in a combination in which there is provided a releasable means for operatively supporting the sight pin by the framing means, permitting removal and replacement of the sight pin.

23. The invention as set forth in claim 19, in a combination in which there is provided a releasable means for operatively supporting the sight pin by the framing means, permitting adjustability of the sight pin with respect to the framing means.

24. The invention as set forth in claim 19, in a combination in which the first support means of the pendulum means comprises an axle means, and in which there is provided a power source means and circuitry leading therefrom to the light output source means, said circuitry comprising a portion to switch means and a portion which is provided by connections to the said axle means of the first support means of the pendulum means, thereby to complete a circuit through the pendulum means to the power source means, in spite of the movement of the pendulum means.

25. The invention as set forth in claim 24, in a combination in which the circuitry also includes a portion which travels through the first support means, using that portion to gain electrical conductivity to the axle means of the pendulum means.

26. The invention as set forth in claim 24, in a combination in which there is a portion of the pendulum means is provided to be made from non-conductive material, and the axle means is carried by the said portion, permitting the said axle means to be an electrically operative component of the circuitry.

27. The invention as set forth in claim 19, in a combination in which the first support means for the pendulum means comprises axle means;

and in which the framing means carries the first support means supporting said pendulum means, said first support means also comprising a pair of diametrically opposed mechanisms, each of a generally tubular form, connected to the framing means;

each of said mechanisms including adjacent its inner end a bearing for rotatably supporting one of said pendulum support means axles, each of said mechanisms also having an outer wall means; each of said mechanisms containing interiorly a piston means which is slidable along said mechanisms' interior;

and each of said mechanisms also including a compression spring which is bottomed respectively between the piston means and the outer wall means.

28. The invention as set forth in claim 19, in a combination in which there is provided a light receiver assembly means which includes the light receiver, and in which the light receiver assembly means comprises a tube means which receives fiber optic cable means through one end of the tube means, and extends through the tube means to the opposite end thereof;

and there is also provided an adjustment means for varying the position of said tube means, to change the tube means for its effect of light receiving ability with respect to the tube means' registry with the pendulum's light source path.

29. A weaponry sight means, comprising:

a framing means for support by the associated weaponry;

a pendulum means;

first support means supporting said pendulum means for relative rotational motion with respect to the framing means;

in a combination in which there is provided a light output assembly, and in which there is provided a light receiver, and also provided an electrically energizable light source which is carried by the pendulum, and which travels in accordance with the arcuate path of the pendulum, and which illuminates the light receiver;

there being provided a fiber optic cable means, carried by the light receiver and leading to the light output assembly to transfer light through the light output assembly to a sight pin;

in a combination in which there is/are provided one or more light output source means units in the pendulum means, capable of emitting light;

and there is/are provided one or more fiber optic receiver means units in the framing means, and it/they is/are arrangeable in slot means provided in the framing means to receive light emitted from a respective light output source means unit, of the pendulum means, at a selected one of a plurality of locations in the slot means.

30. The invention as set forth in claim 29, in a combination in which the plurality of locations are provided by the provision of at least two slot means, both of which slot means are concentric about the axis of the rotation of said pendulum means.

31. A forearm stock means for an actuator means which carries a light output source means for a fiber optic assembly means for associated weaponry, the forearm stock means providing support for the actuator means interiorly of the forearm stock means, the forearm stock means being operatively supported by the associated weaponry's lover section, operative to support and guide the weaponry correspondingly supported by the forearm stock means.

32. The invention as set forth in claim 31, in a combination in which the forearm stock means of an associated weapon operatively supports the actuator carrying the light output source means interiorly of the forearm stock.

33. The invention as set forth in claim 31, in a combination including a mounting means, the mounting means being a forearm stock sight mount handle which operatively supports the top portion of the weapon;

and in which the fiber optic means is operatively supported by the forearm stock sight mount handle. assembly means.

34. A variable illuminable fiber optic sight means for associated weaponry, comprising:

a pendulum which carries a light output source which emits light, a light receiver means which receives light from the pendulums light output source, and transfers that light through cladded fiber optic cable means, in combination with a light output assembly in combination with a fiber optic sight pin, the light output assembly providing adjustment means for varying the illumination of the fiber optic cable means being transferred to the sight pin for varying illumination being emitted from the fiber optic cable therein.

35. The invention as set forth in claim 34, also comprising:

a framing means for support by the associated weaponry:

a pendulum means;

support means supporting said pendulum means for relative rotational motion in an arcuate path with respect to the framing means;

in a combination in which there is provided a light output assembly means, which includes a sight pin means for optical alignment with the associated target being used, and means supporting the output assembly means, and in which there is provided a light receiver assembly means, supported by the framing means, and also provides an energizable light output means which is carried by the pendulum means, and which travels in accordance with the arcuate path of the pendulum means, and which said light output means illuminates the light receiver means in a corresponding arcuate path;

there being provided a fiber optic cable means, carried by the light receiver assembly means and leading to the light output assembly means to transmit light through the light output assembly means.

36. A weaponry sight device for an associated weaponry, the sight device comprising:

a framing means for support by the associated weaponry;

the sight device comprising components including:

an actuator means;

a first support axle means supporting said actuator means, and said axle means is supported by the framing means for operative motion of the actuator means with respect to the framing means;

a cam means movably supported by the actuator means for operative motion with respect to the actuator means;

a first manual adjustment means operatively supported by the actuator means for moving the cam means with respect to the actuator means;

a laser means, a laser holder means; and an arm means; the said laser holder means being provided with a second axle means, which provides support for the laser holder means and the arm means with respect to the sight device framing means;

a second manual adjustment means to adjust the laser holder means position, with respect to the framing means, thereby adjusting the orientation of the laser means being held by the laser holder means, in a combination in which the second manual means comprises a control screw means operatively connected to the laser holder means, the second axle means rotatably supporting the said laser holder means and also supporting the arm means with respect to the framing means, the arm means providing a means to follow the cam means so as to provide that when the control screw means is adjusted the laser holder means moves with respect to the framing means thus adjusting the orientation of the laser means with respect to the framing means.

37. A weaponry sight device for an associated weaponry, the sight device comprising:

a framing means for support by the associated weaponry;

the sight device comprising components including:

a pendulum means;

a first support axle means supporting said pendulum means, and said axle means is supported by the framing means for relative motion of the pendulum means with respect to the framing means;

a cam means movably supported by the pendulum means for vertical motion with respect to the pendulum means;

a laser means;

a laser holder means;

an arm means operatively connected to the cam means and the laser holder means;

the said laser holder means being provided with a second axle means, which provides support for the laser holder means and the arm means with respect to the sight device framing means;

an adjustment means to adjust the sight device with respect to the laser means and the cam means;

in a combination in which the arm means carries follower means which provide following, by the arm means, of the cam means;

and relative rotational motion of the pendulum means, with respect to the framing means, will carry the cam means to rotate about the axis of rotation of the pendulum means, thereby providing automatic adjustment of the laser holder means and the laser means, with respect to the framing means, without the use of the control screw means.

38. The invention as set forth in claim 37, in a combination in which the arm means carries follower means which provide following by the arm means of the cam means.

39. A weaponry sight device according to claim 37, having light output source means capable of emitting light to a light receiver means, in a combination in which there is provided one or more fiber optic receiver means which is/are arranged to receive light emitted from respective light output source means.

40. The invention as set forth in claim 39, in a combination in which there is provided cladded fiber optics cable for transferring light from the light output source means, and including the one or more fiber optics receiver means for receiving light from the respective light output source means.

41. A weaponry sight device for associated weaponry, as set forth in claim 37, having a forearm stock means for associated weaponry having (a) a laser sight means with a beam changeable lens means, and (b) fiber optic sight means, the forearm stock means having a pendulum means carrying an energizable light output source means to illuminate the fiber optic sight means when the fiber optic sight means is being used, when ambient light conditions overcome the laser beam being emitted by the laser sight means.

42. A forearm stock means for associated weaponry; having a projectile launching rail having (a) a laser sight means and (b) a fiber optic sight means, or a projectile tube;

the forearm stock means having a pendulum means carrying an energizable light output source means mounted interiorly of the forearm stock means, the energizable light output source means illuminates the fiber optic sight means when the fiber optic sight means is being used, when ambient light conditions overcome the laser beam being emitted by the laser sight means.

43. The invention as set forth in claim 42, in a combination in which the forearm stock means comprises an operative open space, interiorly, in which the open space's interior provides walls which provide a framing means, the framing means providing an operative support means to operatively support the laser sight means, and the fiber optic sight means.

44. The invention as set forth in claim 42, in a combination in which the laser sight means operatively installed in the forearm stock means is provided a horizontal adjustment means, the horizontal adjustment means providing horizontal adjustment of the sight means, with respect to vertical alignment, to achieve precise vertical alignment or a weapon's projectile or projectile tube.

45. A weaponry sight device for an associated weaponry, the sight device comprising:

a framing means for support by the associated weaponry;

the sight device comprising components including;

an actuator means;

a first support axle means supporting said actuator means, and said axle means is supported by the framing means for operative motion of the actuator means with respect to framing means;

a cam means movably supported by the actuator means for operative motion with respect to the actuator means;

a first manual adjustment means operatively supported by the actuator means for moving the cam means with respect to the actuator means;

a laser means, a laser holder means; and an arm means; the said laser holder means being provided with a second axle means, which provides support for the laser holder means and the arm means with respect to the sight device framing means;, a second manual adjustment means to adjust the laser holder means position, with respect to the framing means, thereby adjusting the orientation of the laser means being held by the laser holder means, in a combination in which the second manual means comprises a control screw means operatively connected to the laser holder means, the second axle means rotatably supporting the said laser holder means and also supporting the arm means with respect to the framing means, the arm means providing a means to follow the cam means so as to provide that when the control screw means is adjusted the laser holder means moves with respect to the framing means thus adjusting the orientation of the laser means with respect to the framing means, in a combination in which there is provided a mounting means for a laser sight means for an associated weapon having a forearm stock, the mounting means including a support means operative to to guide the user in aiming the weapon, and in which the said sight means is supported by the veapon's lower section;

the lower section being a forearm stock of the weapon, in which the sight means is supported by the interior of said forearm stock, and in which the interior walls provide the framing means which is used for supporting the sight means.

* * * * *